US008978750B2

(12) United States Patent
Noske et al.

(10) Patent No.: US 8,978,750 B2
(45) Date of Patent: Mar. 17, 2015

(54) SIGNAL OPERATED ISOLATION VALVE

(75) Inventors: Joe Noske, Houston, TX (US); Roddie R. Smith, Aberdeen (GB); Paul L. Smith, Katy, TX (US); Thomas F. Bailey, Houston, TX (US); Christopher L. McDowell, New Caney, TX (US); Frederick T. Tilton, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 671 days.

(21) Appl. No.: 13/227,847

(22) Filed: Sep. 8, 2011

(65) Prior Publication Data

US 2012/0067594 A1 Mar. 22, 2012

Related U.S. Application Data

(60) Provisional application No. 61/384,493, filed on Sep. 20, 2010.

(51) Int. Cl.

| | |
|---|---|
| ***E21B 34/06*** | (2006.01) |
| ***E21B 47/12*** | (2012.01) |
| ***E21B 34/08*** | (2006.01) |
| ***E21B 34/14*** | (2006.01) |
| ***E21B 43/10*** | (2006.01) |

(Continued)

(52) U.S. Cl.

CPC ..... *E21B 47/12* (2013.01); *E21B 34/08* (2013.01); *E21B 34/14* (2013.01); *E21B 43/103* (2013.01); *E21B 2021/006* (2013.01); *E21B 2034/005* (2013.01)

USPC ..... 166/66.6; 166/332.8; 166/373; 175/57

(58) Field of Classification Search

USPC ..... 175/318, 57; 166/332.8, 66.6, 373

See application file for complete search history.

(56) References Cited

U.S. PATENT DOCUMENTS

| | | | |
|---|---|---|---|
| 4,806,928 | A | 2/1989 | Veneruso |
| 5,145,005 | A | 9/1992 | Dollison |

(Continued)

FOREIGN PATENT DOCUMENTS

| | | | |
|---|---|---|---|
| WO | 2010/054407 | A1 | 5/2010 |
| WO | 2011119448 | A2 | 9/2011 |
| WO | WO 2011119157 | A1 * | 9/2011 |

OTHER PUBLICATIONS

PCT International Search Report and Written Opinion dated Mar. 13, 2013, International Application No. PCT/US2011/052383.

(Continued)

*Primary Examiner* — Giovanna Wright

(74) *Attorney, Agent, or Firm* — Patterson & Sheridan, L.L.P.

(57) ABSTRACT

A method of drilling a wellbore includes drilling the wellbore through a formation by injecting drilling fluid through a drill string and rotating a drill bit. The drill string includes a shifting tool, a receiver in communication with the shifting tool, and the drill bit. The method further includes retrieving the drill string from the wellbore through a casing string until the shifting tool reaches an actuator. The casing string includes an isolation valve in an open position and the actuator. The method further includes sending a wireless instruction signal to the receiver. The shifting tool engages the actuator in response to the receiver receiving the instruction signal. The method further includes operating the actuator using the engaged shifting tool, thereby closing the isolation valve and isolating the formation from an upper portion of the wellbore.

21 Claims, 20 Drawing Sheets

(51) Int. Cl.
*E21B 21/00* (2006.01)
*E21B 34/00* (2006.01)

(56) References Cited

U.S. PATENT DOCUMENTS

| | | | | |
|---|---|---|---|---|
| 5,797,454 | A | 8/1998 | Hipp | |
| 6,152,232 | A | 11/2000 | Webb et al. | |
| 6,209,663 | B1 | 4/2001 | Hosie | |
| 6,468,163 | B1 * | 10/2002 | Boffelli et al. | 464/29 |
| 6,644,110 | B1 | 11/2003 | Curtis et al. | |
| 6,872,879 | B1 | 3/2005 | Serras et al. | |
| 7,252,152 | B2 | 8/2007 | LoGiudice et al. | |
| 7,347,272 | B2 | 3/2008 | Patel et al. | |
| 7,451,809 | B2 | 11/2008 | Noske et al. | |
| 7,597,151 | B2 | 10/2009 | Curtis et al. | |
| 7,789,156 | B2 | 9/2010 | Pia | |
| 8,733,448 | B2 * | 5/2014 | Skinner et al. | 166/373 |
| 2003/0150622 | A1 | 8/2003 | Patel et al. | |
| 2005/0230118 | A1 | 10/2005 | Noske et al. | |
| 2006/0157240 | A1 * | 7/2006 | Shaw et al. | 166/255.1 |
| 2007/0285275 | A1 | 12/2007 | Purkis et al. | |
| 2008/0041597 | A1 | 2/2008 | Fisher et al. | |
| 2008/0245531 | A1 | 10/2008 | Noske et al. | |
| 2009/0230340 | A1 | 9/2009 | Purkis | |
| 2009/0266544 | A1 | 10/2009 | Redlinger et al. | |
| 2009/0272539 | A1 | 11/2009 | Lloyd et al. | |
| 2009/0272544 | A1 | 11/2009 | Giroux et al. | |
| 2009/0294124 | A1 * | 12/2009 | Patel | 166/255.2 |
| 2011/0005772 | A1 | 1/2011 | Ceccarelli et al. | |

OTHER PUBLICATIONS

Singapore Search Report and Written Opinion dated Dec. 10, 2013, in Singapore Patent Application No. 201302009.4.
Canadian Office Action dated May 30, 2014 for Application No. 2,811,118.

* cited by examiner

SIGNAL OPERATED ISOLATION VALVE

CROSS-REFERENCE TO RELATED APPLICATIONS

This application claims the benefit of U.S. Prov. Pat. App. No. 61/384,493, entitled "Signal Operated Isolation Valve", filed on Sep. 20, 2010, which is herein incorporated by reference in its entirety.

BACKGROUND OF THE INVENTION

1. Field of the Invention

Embodiments of the invention generally relate to a signal operated isolation valve.

2. Description of the Related Art

A hydrocarbon bearing formation (i.e., crude oil and/or natural gas) is accessed by drilling a wellbore from a surface of the earth to the formation. After the wellbore is drilled to a certain depth, steel casing or liner is typically inserted into the wellbore and an annulus between the casing/liner and the earth is filled with cement. The casing/liner strengthens the borehole, and the cement helps to isolate areas of the wellbore during further drilling and hydrocarbon production.

Once the wellbore has reached the formation, the formation is then usually drilled in an overbalanced condition meaning that the annulus pressure exerted by the returns (drilling fluid and cuttings) is greater than a pore pressure of the formation. Disadvantages of operating in the overbalanced condition include expense of the drilling mud and damage to formations by entry of the mud into the formation. Therefore, underbalanced or managed pressure drilling may be employed to avoid or at least mitigate problems of overbalanced drilling. In underbalanced and managed pressure drilling, a light drilling fluid, such as liquid or liquid-gas mixture, is used instead of heavy drilling mud so as to prevent or at least reduce the drilling fluid from entering and damaging the formation. Since underbalanced and managed pressure drilling are more susceptible to kicks (formation fluid entering the annulus), underbalanced and managed pressure wellbores are drilled using a rotating control device (RCD) (aka rotating diverter, rotating BOP, rotating drilling head, or PCWD). The RCD permits the drill string to be rotated and lowered therethrough while retaining a pressure seal around the drill string.

An isolation valve located within the casing/liner may be used to temporarily isolate a formation pressure below the isolation valve such that a drill or work string may be quickly and safely inserted into a portion of the wellbore above the isolation valve that is temporarily relieved to atmospheric pressure. An example of an isolation valve having a flapper is discussed and illustrated in U.S. Pat. No. 6,209,663, which is incorporated by reference herein in its entirety. An example of an isolation valve having a ball is discussed and illustrated in U.S. Pat. No. 7,204,315, which is incorporated by reference herein in its entirety. The isolation valve allows a drill/work string to be tripped into and out of the wellbore at a faster rate than snubbing the string in under pressure. Since the pressure above the isolation valve is relieved, the drill/work string can trip into the wellbore without wellbore pressure acting to push the string out. Further, the isolation valve permits insertion of the drill/work string into the wellbore that is incompatible with the snubber due to the shape, diameter and/or length of the string.

Actuation systems for the isolation valve are typically hydraulic requiring one or two control lines that extend from the isolation valve to the surface. The control lines require crush protection, are susceptible to leakage, and would be difficult to route through a subsea wellhead.

SUMMARY OF THE INVENTION

Embodiments of the invention generally relate to a signal operated isolation valve. In one embodiment, a method of drilling a wellbore includes drilling the wellbore through a formation by injecting drilling fluid through a drill string and rotating a drill bit. The drill string includes a shifting tool, a receiver in communication with the shifting tool, and the drill bit. The method further includes retrieving the drill string from the wellbore through a casing string until the shifting tool reaches an actuator. The casing string includes an isolation valve in an open position and the actuator. The method further includes sending a wireless instruction signal to the receiver. The shifting tool engages the actuator in response to the receiver receiving the instruction signal. The method further includes operating the actuator using the engaged shifting tool, thereby closing the isolation valve and isolating the formation from an upper portion of the wellbore.

In another embodiment, a method of drilling a wellbore includes drilling the wellbore through a formation by injecting drilling fluid through a drill string and rotating a drill bit and retrieving the drill string from the wellbore through a casing string until the drill bit is above a closure member. The casing string includes the closure member in an open position and an actuator. The method further includes sending a wireless instruction signal to the actuator; and closing the closure member, thereby isolating the formation from an upper portion of the wellbore.

In another embodiment, an actuator for use in a wellbore includes: a tubular housing having a bore formed therethrough; a power source; a receiver for receiving a wireless instruction signal; a controller in communication with the power source and antenna; a pump or piston operable to supply pressurized hydraulic fluid to an isolation valve; a position or proximity sensor in communication with the controller for determining a position of the isolation valve; and a lock operably connected to the pump or piston and the controller. The controller is operable to release the lock in response to receiving the instruction signal.

In another embodiment, a shifting tool for use in a wellbore includes: a tubular housing having a bore formed therethrough and a pocket formed in a wall thereof; a driver moveable relative to the housing between an extended position and a retracted position and disposed in the pocket in the retracted position; a piston disposed in the housing, longitudinally movable relative thereto between an engaged position and a disengaged position, and operable to extend the driver when moving from the disengaged position to the engaged position; a lock operable to retain the piston in the engaged position; and an actuator operable to release the lock in response to receiving an instruction signal.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
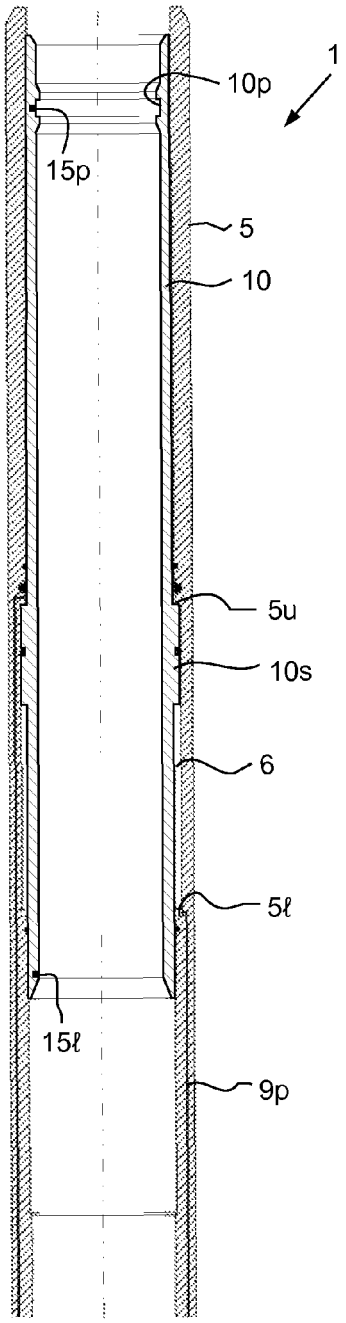
FIGS. 1A-C are cross-sections of an isolation assembly in the closed position, according to one embodiment of the present invention.
Figure 1B:
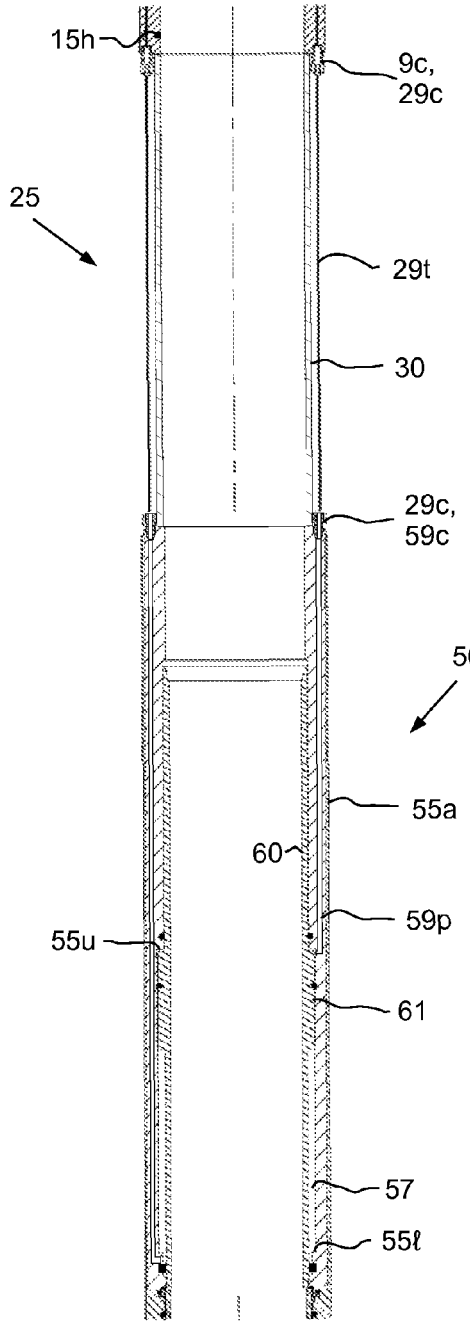
Figure 1C:
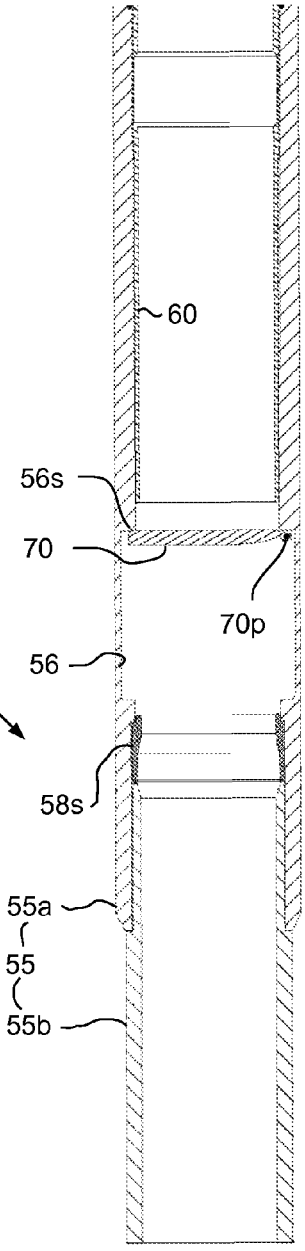

FIGS. 1A-C are cross-sections of an isolation assembly in the closed position, according to one embodiment of the present invention. The isolation assembly may include one or more power subs 1, a spacer sub 25, and the isolation valve 50. The isolation assembly may be assembled as part of a casing 1015 or liner string and run-into a wellbore 1005 (see FIG. 11B). The casing 1015 or liner string may be cemented in the wellbore 1005 or be a tie-back casing string. Although only one power sub 500 is shown, two power subs may be used in a three-way configuration, discussed below.

The power sub 1 may include a tubular housing 5 and a tubular mandrel 10. The housing 5 may have couplings (not shown) formed at each longitudinal end thereof for connection with other components of the casing/liner string. The couplings may be threaded, such as a box and a pin. The housing 5 may have a central longitudinal bore formed therethrough. Although shown as one piece, the housing 5 may include two or more sections to facilitate manufacturing and assembly, each section connected together, such as fastened with threaded connections.

The mandrel 10 may be disposed within the housing 5 and longitudinally movable relative thereto. The mandrel 10 may have a profile 10*p* formed in an inner surface thereof for receiving a cleat 130 of a shifting tool 100. The mandrel 10 may further have one or more position indicators 15*p,l* embedded in an inner surface thereof and the housing 5 may have one or more position indicator 15*h* embedded in an inner surface thereof. Alternatively, the indicator 15*h* may instead be embedded in an inner surface of the spacer housing 30. The mandrel 10 may further have a piston shoulder 10*s* formed in or fastened to an outer surface thereof. The piston shoulder 10*s* may be disposed in a chamber 6. The housing 5 may further have upper 5*u* and lower 5*l* shoulders formed in an inner surface thereof. The chamber 6 may be defined radially between the mandrel 10 and the housing 5 and longitudinally between an upper seal disposed between the housing 5 and the mandrel 10 proximate the upper shoulder 5*u* and a lower seal disposed between the housing 5 and the mandrel 10 proximate the lower shoulder 5*l*. Hydraulic fluid may be disposed in the chamber 6. Each end of the chamber 6 may be in fluid communication with a respective hydraulic coupling 9*c* via a respective hydraulic passage 9*p* formed longitudinally through a wall of the housing 5.

The spacer sub 25 may include a tubular housing 30 having couplings (not shown) formed at each longitudinal end thereof for connection with the power sub 1 and the isolation valve 50. The couplings may be threaded, such as a pin and a box. The spacer sub 25 may further include hydraulic conduits, such as tubing 29*t*, fastened to an outer surface of the housing 30 and hydraulic couplings 29*c* connected to each end of the tubing 29*t*. The hydraulic couplings 29*c* may mate with respective hydraulic couplings of the power sub 1 and the isolation valve 50. The spacer sub 25 may provide fluid communication between a respective power sub passage 9*p* and a respective isolation valve passage 59*p*. The spacer sub 25 may also have a length sufficient to accommodate the BHA of the drill string while the shifting tool 100 is engaged with the power sub 1, thereby providing longitudinal clearance between the drill bit and a flapper 70. The spacer sub length may depend on the length of the BHA.

The isolation valve 50 may include a tubular housing 55, a flow tube 60, and a closure member, such as the flapper 70. As discussed above, the closure member may be a ball (not shown) instead of the flapper 70. To facilitate manufacturing and assembly, the housing 55 may include one or more sections 55*a,b* each connected together, such as fastened with threaded connections and/or fasteners. The housing 55 may further include an upper adapter (not shown) connected to section 55*a* for connection to the spacer sub 25 and a lower adapter (not shown) connected to the section 55*b* for connection with casing or liner. The housing 55 may have a longitudinal bore formed therethrough for passage of a drill string.

The flow tube 60 may be disposed within the housing 55. The flow tube 60 may be longitudinally movable relative to the housing 55. A piston 61 may be formed in or fastened to an outer surface of the flow tube 60. The piston 61 may include one or more seals for engaging an inner surface of a chamber 57 formed in the housing 55 and one or more seals for engaging an outer surface of the flow tube 60. The housing 55 may have upper 55*u* and lower 55*l* shoulders formed in an inner surface thereof. The chamber 57 may be defined radially between the flow tube 60 and the housing 55 and longitudinally between an upper seal disposed between the housing 55 and the flow tube 60 proximate the upper shoulder 55*u* and a lower seal disposed between the housing 55 and the flow tube proximate the lower shoulder 55*f*. Hydraulic fluid may be disposed in the chamber 57. Each end of the chamber 57 may be in fluid communication with a respective hydraulic coupling 59*c* via a respective hydraulic passage 59*p* formed through a wall of the housing 55.

The flow tube 60 may be longitudinally movable by the piston 61 between the open position and the closed position. In the closed position, the flow tube 60 may be clear from the flapper 70, thereby allowing the flapper 70 to close. In the open position, the flow tube 60 may engage the flapper 70, push the flapper 70 to the open position, and engage a seat 58*s* formed in the housing 55. Engagement of the flow tube 60 with the seat 58*s* may form a chamber 56 between the flow tube 60 and the housing 55, thereby protecting the flapper 70 and the flapper seat 56*s*. The flapper 70 may be pivoted to the housing 55, such as by a fastener 70*p*. A biasing member, such as a torsion spring (not shown), may engage the flapper 70 and the housing 55 and be disposed about the fastener 70*p* to bias the flapper 70 toward the closed position. In the closed position, the flapper 70 may fluidly isolate an upper portion of the valve from a lower portion of the valve.

Figures 2A, 2B, 2C:
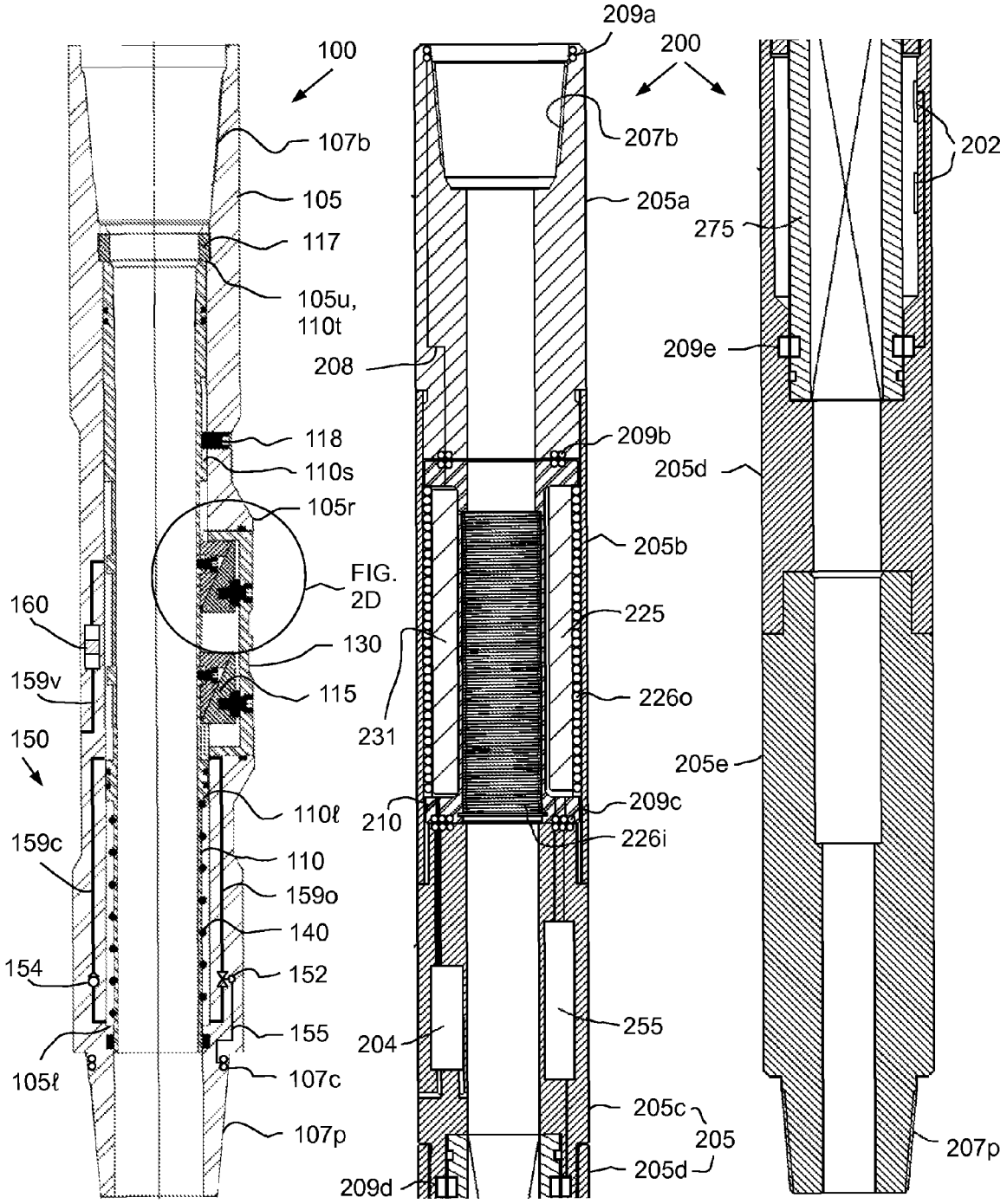
FIG. 2A is a cross-section of a shifting tool for actuating the isolation assembly between the positions, according to another embodiment of the present invention.
FIGS. 2B and 2C illustrate a telemetry sub for use with the shifting tool.
Figure 2D:
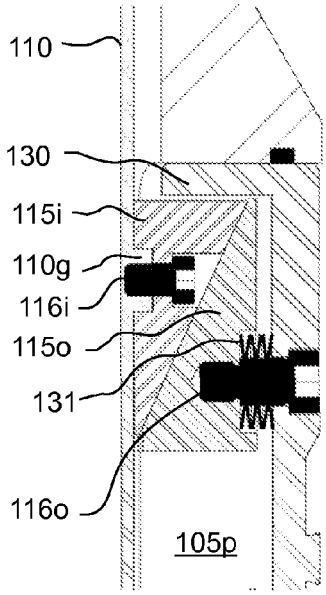
FIG. 2D is an enlargement of a portion of FIG. 2A.

FIG. 2A is a cross-section of a shifting tool 100 for actuating the isolation assembly between the positions, according to another embodiment of the present invention. FIG. 2D is an enlargement of a portion of FIG. 2A. The shifting tool 100 may include a tubular housing 105, a tubular piston 110, and one or more longitudinal drivers, such as cleats 130, and an actuator, such as a hydraulic lock 150. The housing 105 may have couplings 107*b,p* formed at each longitudinal end thereof for connection with other components of a drill string. The couplings may be threaded, such as a box 107*b* and a pin 107*p*. The housing 105 may have a central longitudinal bore formed therethrough for conducting drilling fluid. The housing 105 may include one or more sections (only one section shown) to facilitate manufacturing and assembly, each section connected together, such as fastened with threaded connections. An inner surface of the housing 105 may have an upper 105*u* and lower 105*l* shoulder formed therein.

The piston 110 may be disposed within the housing 105 and longitudinally movable relative thereto between a retracted position (shown) and an engaged position. The piston 110 may have a top 110*t*, one or more profiles, such as slots 110*s*, formed in an outer surface thereof, one or more lugs 110*g* formed in an outer surface thereof, and a shoulder 110*l* formed in an outer surface thereof. One or more fasteners, such as pins 118, may be disposed through respective holes formed through a wall of the housing and extend into the respective slots 110*s*, thereby rotationally connecting the piston 110 to the housing 105. In the retracted position, the piston top 110*t* may be stopped by engagement with a fastener, such as a ring 117, connected to the housing 105, such as by a threaded connection. The stop ring 117 may engage the upper housing shoulder 105*u*. The piston top 105*t* may have an area greater than an area of a bottom of the piston.

One or more ribs 105*r* may be formed in an outer surface of the housing 105 and spaced therearound. A pocket 105*p* may be formed through each rib 105*r*. The cleat 130 may be disposed in the pocket 105*p* in the retracted position. The cleat 130 may be moved outward toward to the engaged position by one or more pushers, such as wedges 115, disposed in the pocket 105*p*. Each wedge 115 may include an inner slip 115*i* and an outer slip 115*o*. The inner slip 115*i* may be connected to the piston lug 110*g*, such as by a fastener 116*i*. The outer slip 115*o* may be connected to the cleat 130, such as by a fastener 116*o*. A clearance may be provided between the cleat 130 and the outer slip 115*o* and/or fastener 116*o* and a biasing member, such as a Bellville spring 131, may be disposed between the outer slip 115*o* and the cleat 130 to bias the cleat 130 into engagement with the fastener 116*o*. A seal may be disposed between the cleat 130 and the housing 105.

An upper chamber may be defined radially between the piston 110 and the housing 105 and may include the pocket 105*p*. The upper chamber may be longitudinally defined between one or more upper seals disposed between the housing 105 and the piston 110 proximate the piston top 110*t* and one or more intermediate seals disposed between the housing 105 and the piston 110 proximate the lower shoulder 110*l*. Hydraulic fluid may be disposed in the upper chamber. A compensator piston 160 may be disposed in a passage 159*v* formed through a wall of the housing 105. A lower face of the compensator piston 160 may be in fluid communication with an exterior of the shifting tool 100 (i.e., the annulus 1025 (FIG. 11C) when disposed in the wellbore 1005) and an upper face of the compensator piston may be in fluid communication with the upper chamber. The compensator piston 160 may serve to equalize pressure of the hydraulic fluid with annulus pressure and to account for changes in volume of the upper chamber due to temperature and/or movement of the cleat 130. A biasing member, such as a coil spring 140, may be disposed against the lower shoulders 110*l*, 105*l*, thereby biasing the piston 110 toward the retracted position. The coil spring may 140 may be disposed in a lower chamber longitudinally defined between the intermediate seals and a lower seal disposed between the housing 105 and the piston 110 proximate the lower housing shoulder 105*l* and radially between the piston 110 and the housing 105. Hydraulic fluid may be disposed in the lower chamber.

The hydraulic lock 150 may include one or more passages 159*c,o* formed through a wall of the housing 105 and one or more valves 152, 154 interconnected with the respective passages 159*c,o*. The hydraulic lock 150 may provide selective fluid communication between the upper and lower chambers. The valve 154 may be a check valve operable to allow fluid flow from the upper chamber to the lower chamber and prevent fluid flow from the lower chamber to the upper chamber. The valve 152 may be a control valve, such as a solenoid operated shutoff valve, operable between an open position and a closed position. The shutoff valve 152 may bi-directionally prevent flow between the upper and lower chambers in the closed position and bi-directionally allow flow between the chambers in the open position. The solenoid may be biased toward the closed position. Lead wires 155 may extend from the control valve 152 to the pin 107*p*. An electrical coupling 107*c* may be disposed in the pin 107*p* for receiving electricity from the telemetry sub 200. The coupling 107*c* may be inductive or contact rings.

Alternatively, the control valve 152 may be a solenoid operated check valve and the check valve 154 and corresponding passage 159*c* may be omitted. The solenoid operated check valve may operate as a check valve in the closed position and allow bi-directional flow in the open position. Alternatively, the actuator 150 may be an electromechanical lock (see actuator 750, discussed below).

FIGS. 2B and 2C illustrate a telemetry sub 200 for use with the shifting tool 100. The telemetry sub 200 may include an upper adapter 205*a*, one or more auxiliary sensors 202*a,b*, a pressure sensor 204, a downlink housing 205*b*, a sensor housing 205*c*, a pressure sensor 204, a downlink mandrel 210, an uplink housing 205*d*, a lower adapter 205*e*, one or more electrical couplings 209*a-e*, an electronics package 225, a battery 231, one or more antennas 226*i,o*, a tachometer 255, and a mud pulser 275. The housings 205*b-d* may each be modular so that any of the housings 205*b-d* may be omitted and the rest of the housings may be used together without modification thereof. Alternatively, any of the sensors or electronics of the telemetry sub 200 may be incorporated into the shifting tool 100 and the telemetry sub 200 may be omitted.

The adapters 205*a,e* may each be tubular and have a threaded coupling, such as a pin 207*p* and a box 207*b*, formed at a longitudinal end thereof for connection with the shifting tool 100 and another component of the drill string. The electrical coupling 209*a* may be disposed in the box 207*b* for transmitting electricity to the control valve 152. The couplings 209*a-e* may be inductive or contact rings. Alternatively, a wet or dry pin and socket connection may be used to connect the telemetry sub 200 and the shifting tool 100 instead of the pin and box. Lead wires 208 may connect the couplings 209*a,b* and the other components with the electrical couplings. Each housing 205*a-e* may be longitudinally and rotationally connected together by one or more fasteners, such as screws (not shown), and sealed by one or more seals, such as o-rings (not shown).

The sensor housing 205*c* may house the pressure sensor 204 and the tachometer 255. The pressure sensor 204 may be in fluid communication with a bore of the sensor housing 205*c* via a first port and in fluid communication with the annulus via a second port. Additionally, the pressure sensor 204 may also measure temperature of the drilling fluid and/or returns. The sensors 204,255 may be in data communication with the electronics package 225 by engagement of the contacts 207*c* disposed at a top of the mandrel 210 with corresponding contacts 207*c* disposed at a bottom of the downlink housing 205*b*. The sensors 204,255 may also receive electrical power via the contacts. The sensor housing 205*c* may also relay data between the mud pulser 275, the auxiliary sensors 202, and the electronics package 225 via leads 208 and radial contacts 209*d,e*. The auxiliary sensors 202 may be magnetometers which may be used with the tachometer 255 for determining directional information during drilling, such as azimuth, inclination, and/or tool face/bent sub angle.

Each antenna 226*i,o* may include an inner liner, a coil, and an outer sleeve disposed along an inner surface of the downlink mandrel 210 or the downlink housing 205*b*. The liner may be made from a non-magnetic and non-conductive material, such as a polymer or composite, have a bore formed longitudinally therethrough, and have a helical groove formed in an outer surface thereof. The coil may be wound in the helical groove and made from an electrically conductive material, such as a metal or alloy. The outer sleeve may be made from the non-magnetic and non-conductive material and may be insulate the coil from the downlink mandrel 210 or downlink housing 205*b*. The antennas 226*i,o* may be longitudinally and rotationally connected to the downlink mandrel 206 and sealed from a bore of the telemetry sub 200.

Figure 3A:
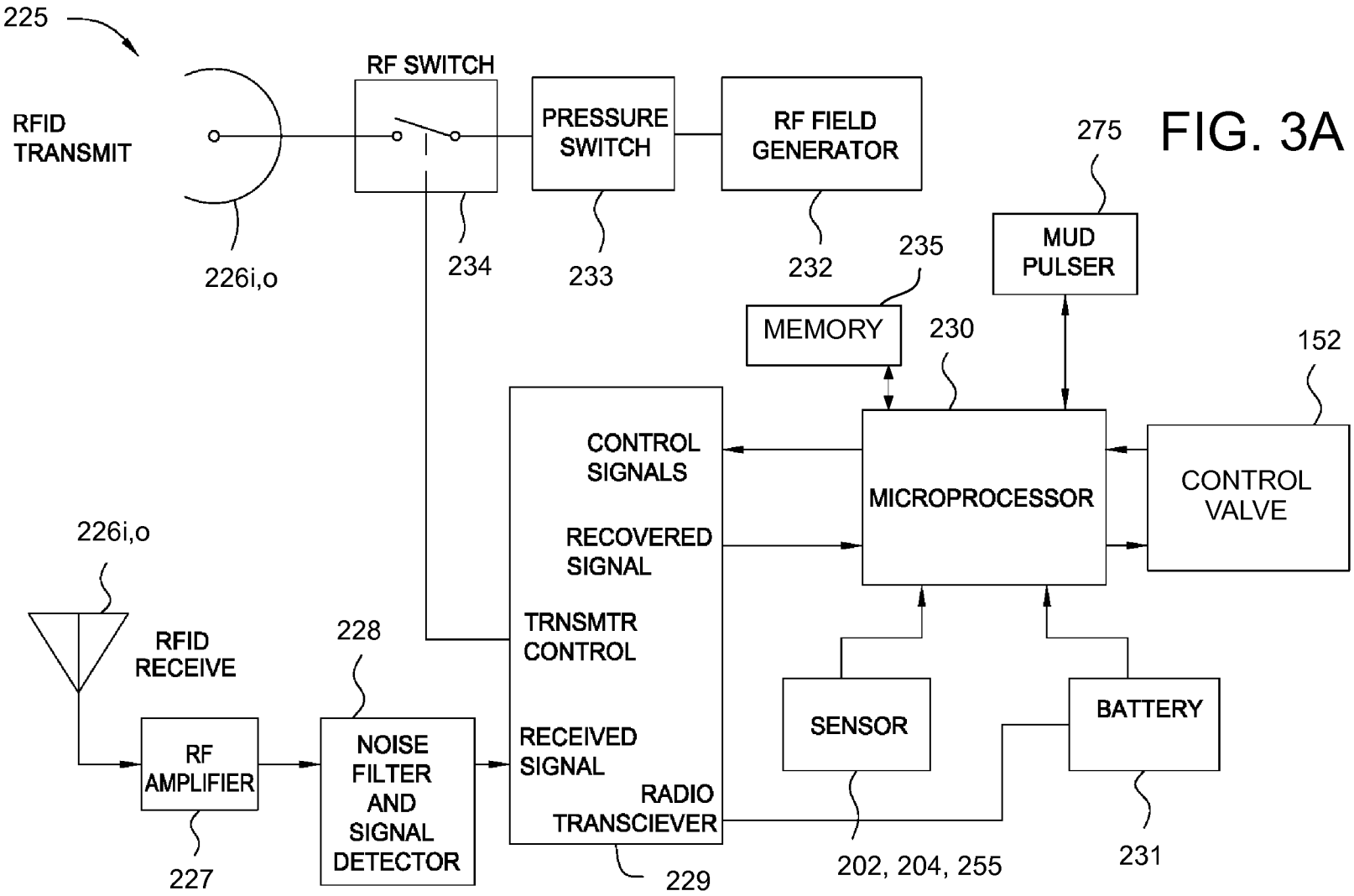
FIG. 3A illustrates an electronics package of the telemetry sub.
Figure 3D:
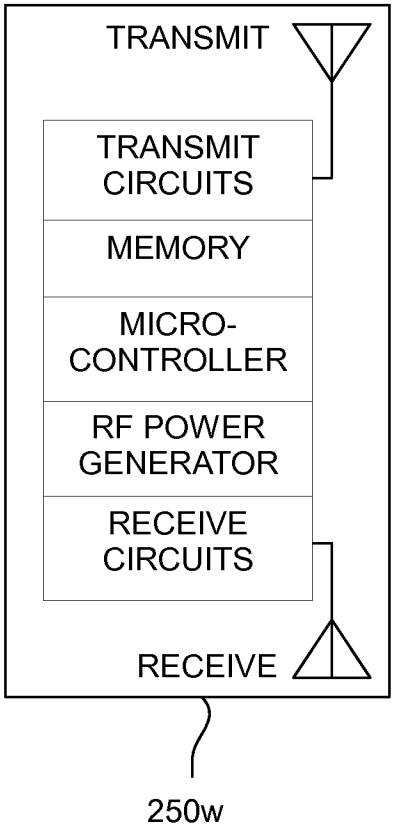
FIG. 3D illustrates a Wireless Identification and Sensing Platform (WISP) RFID tag for use with the telemetry sub.
Figure 3C:
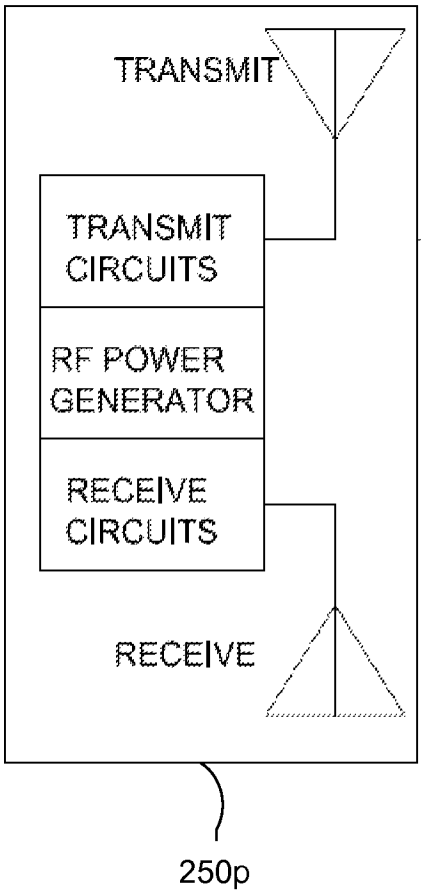
FIG. 3C illustrates a passive RFID tag for use with the telemetry sub.
Figure 3B:
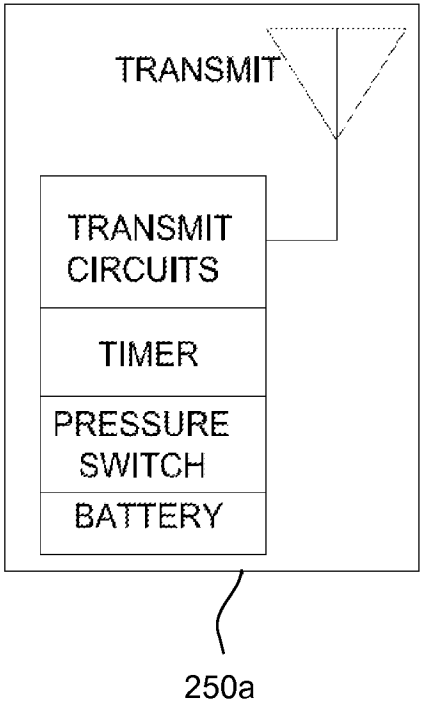
FIG. 3B illustrates an active RFID tag for use with the telemetry sub.

FIG. 3A illustrates the electronics package 225. FIG. 3B illustrates an active RFID tag 250*a* for use with the telemetry sub 200. FIG. 3C illustrates a passive RFID tag 250*p* for use with the telemetry sub 200. FIG. 3D illustrates a wireless identification and sensing platform (WISP) RFID tag 250*w* for use with the telemetry sub 200. The electronics package 225 may communicate with any of the RFID tags 250*a,p,w*. Any of the RFID tags 250*a,p,w* may be individually encased and dropped or pumped through the drill string. The electronics package 225 may be in electrical communication with the antennas 226*i,o* and receive electricity from the battery 231. The electronics package 225 may include an amplifier 227, a filter and detector 228, a transceiver 229, a microprocessor 230, an RF switch 234, a pressure switch 233, and an RF field generator 232. Alternatively, the tags 250*a,p,w* and electronics package 225 may operate on any other wireless frequency, such as acoustic.

The pressure switch 233 may remain open at the surface to prevent the electronics package 225 from becoming an ignition source. Once the telemetry sub 200 is deployed to a sufficient depth in the wellbore, the pressure switch 233 may close. The microprocessor 230 may also detect deployment in the wellbore using pressure sensor 205. The microprocessor 230 may delay activation of the transmitter for a predetermined period of time to conserve the battery 231.

When it is desired to operate the shifting tool 100, one of the tags 250*a,p,w* may be pumped or dropped from the drilling rig 1000 (FIG. 11A) to the antenna 226*i*. If a passive 250*p* or WISP tag 250*w* is deployed, the microprocessor 230 may begin transmitting a signal and listening for a response. Once the tag 250*p,w* is deployed into proximity of the antenna 226*i*, the tag 250*p,w* may receive the signal, convert the signal to electricity, and transmit a response signal. The antenna 226*i* may receive the response signal and the electronics package 225 may amplify, filter, demodulate, and analyze the signal. If the signal matches a predetermined instruction signal, then the microprocessor 230 may operate the control valve 152 by supplying electricity thereto. The instruction signal carried by the tag 250*a,p,w* may include a command, such as to extend or retract the cleat 130. If an active tag 250*a* is used, then the tag 250*a* may include its own battery, pressure switch, and timer so that the tag 250*a* may perform the function of the components 232-234.

The WISP tag 250*w* may include a date and time stamp so that multiple tags may be pumped for redundancy. In this manner, if any of the tags become stuck in the wellbore and later dislodged, the microprocessor 230 may know to disregard the command if it has already received the command with the same or a later date and time stamp.

Figure 3F:
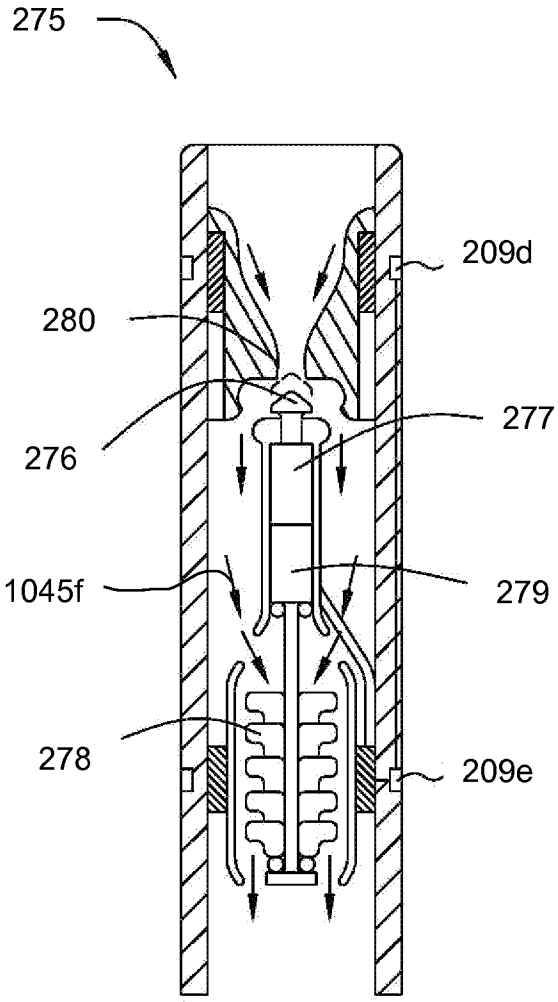
FIG. 3F illustrates a mud pulser of the telemetry sub.
Figure 3E:
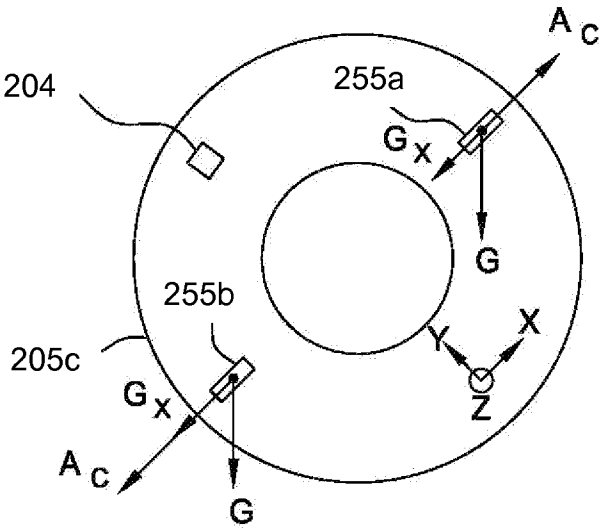
FIG. 3E illustrates accelerometers of the telemetry sub.

FIG. 3E is a schematic cross-sectional view of the sensor module. The tachometer 255 may include two diametrically opposed single axis accelerometers 255*a,b*. The accelerometers 255*a,b* may be piezoelectric, magnetostrictive, servo-controlled, reverse pendular, or microelectromechanical (MEMS). The accelerometers 255*a,b* may be radially X oriented to measure the centrifugal acceleration Ac due to rotation of the telemetry sub 200 for determining the angular speed. The second accelerometer may be used to account for gravity G if the telemetry sub 200 is used in a deviated or horizontal wellbore. Alternatively, the accelerometers 255*a,b* may be tangentially Y oriented, dual axis, and/or asymmetrically arranged (not diametric and/or each accelerometer at a different radial location). Further, the accelerometers 255*a,b* may be used to calculate borehole inclination and gravity tool face during drilling. Further, the sensor module may include a longitudinal Z accelerometer. Alternatively, magnetometers may be used instead of accelerometers to determine the angular speed.

Instead of using one of the RFID tags 250*a,p,w* to activate the shifting tool 100, an instruction signal may be sent to the controller 230 by modulating angular speed of the drill string according to a predetermined protocol. The modulated angular speed may be detected by the tachometer 255. The microporcessor 230 may then demodulate the signal and operate the shifting tool 100. The protocol may represent data by varying the angular speed on to off, a lower speed to a higher speed and/or a higher speed to a lower speed, or monotonically increasing from a lower speed to a higher speed and/or a higher speed to a lower speed.

FIG. 3F illustrates the mud pulser 275. The mud pulser 275 may include a valve, such as a poppet 276, an actuator 277, a turbine 278, a generator 279, and a seat 280. The poppet 276 may be longitudinally movable by the actuator 277 relative to the seat 280 between an open position (shown) and a choked position (dashed) for selectively restricting flow through the pulser 275, thereby creating pressure pulses in drilling fluid pumped through the mud pulser. The mud pulses may be detected at the surface, thereby communicating data from the microprocessor 230 to the surface. The turbine 278 may harness fluid energy from the drilling fluid pumped therethrough and rotate the generator 279, thereby producing electricity to power the mud pulser 275. The mud pulser 275 may be used to send confirmation of receipt of commands and report successful execution of commands or errors to the surface. The confirmation may be sent during circulation of drilling fluid. Alternatively, a negative or sinusoidal mud pulser may be used instead of the positive mud pulser 275. The microprocessor 230 may also use the turbine 278 and/or pressure sensor 204 as a flow switch and/or flow meter.

Instead of using one of the RFID tags 250*a,p,w* or angular speed modulation to activate the shifting tool 100, a signal may be sent to the microporcessor 230 by modulating a flow rate of the rig drilling fluid pump according to a predetermined protocol. Alternatively, a mud pulser (not shown) may be installed in the rig pump outlet and operated by a surface controller 1070 (FIG. 11A) to send pressure pulses from the drilling rig 1000 to the telemetry sub microprocessor 230 according to a predetermined protocol. The microprocessor 230 may use the turbine and/or pressure sensor as a flow switch and/or flow meter to detect the sequencing of the rig pumps/pressure pulses. The flow rate protocol may represent data by varying the flow rate on to off, a lower speed to a higher speed and/or a higher speed to a lower speed, or monotonically increasing from a lower speed to a higher speed and/or a higher speed to a lower speed. Alternatively, an orifice flow switch or meter may be used to receive pressure pulses/flow rate signals communicated through the drilling fluid from the rig 1000 instead of the turbine 278 and/or pressure sensor 204. Alternatively, the sensor sub may detect the pressure pulses/flow rate signals using the pressure sensor 204 and accelerometers 255*a,b* to monitor for BHA vibration caused by the pressure pulse/flow rate signal.

Alternatively, an electromagnetic (EM) gap sub (not shown) may be used instead of the mud pulser 275, thereby allowing data to be transmitted to the microprocessor and/or to surface using EM waves. Alternatively, a transverse EM antenna may be used instead of the EM gap sub. Alternatively, an RFID tag launcher (not shown) may be used instead of the mud pulser. The tag launcher may include one or more RFID tags 250*w*. The microprocessor 230 may then encode the tags with data and the launcher may release the tags to the surface. Alternatively, an acoustic transmitter may be used instead of the mud pulser. For deeper wells, the drill string may further include a signal repeater (not shown) to prevent attenuation of the transmitted mud pulse. The repeater may detect the mud pulse transmitted from the mud pulser 475 and include its own mud pulser for repeating the signal. As many repeaters may be disposed along the workstring as necessary to transmit the data to the surface, e.g., one repeater every five thousand feet. The repeaters may be used for any of the mud pulser alternatives, discussed above. Repeating the transmission may increase bandwidth for the particular data transmission. Alternatively, the telemetry sub may send and receive instructions via wired drill string.

In operation, the shifting tool 100 and telemetry sub 200 may be assembled as part of the drill string 1050. The drill string 1050 may be run into the wellbore 1005 and the microprocessor 230 may begin transmitting a signal to search for the indicator 15*p*. Conversely, if the valve 50 is being closed after drilling, the microprocessor 230 may be searching for the indicator 15*h* to indicate proximity to the profile 10*p*. The indicators 15*p,l,h* may each be an RFID tag, such as a passive tag 250*p*. The indicator 15*p* may be operable to respond with a signal indicating location at the profile and the indicator 15*l* may be located to correspond to the outer antenna when the cleat 130 is engaged with the profile. Once the outer antenna 226*o* is in range of the indicator 15*p*, the indicator 15*p* may respond, thereby informing the microprocessor 230 of proximity to the profile 10*p*. The microprocessor 230 may send a signal to the rig 1000, such as by using the mud pulser 275. The shifting tool 100 may continue to be lowered until the microprocessor 230 detects the lower indicator 15*l* and sends a signal to the rig 1000 indicating alignment of the cleat 130 with the profile 10*p*.

An instruction signal may then be sent to the telemetry sub 200 by any of the ways, discussed above, such as by pumping the RFID tag 250*p* through the drill string 1050 or modulating rotation of the drill string. Once the signal is sent, drilling fluid may be pumped/continued to be pumped through the drill string, thereby creating a pressure differential between pressure in the drill string 1050 and pressure in the annulus 1025 due to pressure loss through the drill bit 1050*b*. This pressure differential may exert a net downward force on the shifting tool piston 110 which may be hydraulically locked by the closed control valve 152.

Once the telemetry sub 200 receives the signal and opens the control valve 152, the net pressure force may drive the piston 110 longitudinally downward and move the inner slips 115*i* relative to the outer slips 115*o*. The fasteners 116*o* may be wedged outward by the relative longitudinal movement of the slips 115*i,o*. The fasteners 116*o* may push the cleat 130 into engagement with the power sub profile 10*p*. Engagement of the cleat 130 with the profile 10*p* may longitudinally connect the shifting tool 100 and the power sub mandrel 10. The longitudinal connection may be bi-directional or uni-directional. The shifting tool 100 may be lowered (or lowering may continue), thereby also moving the power sub mandrel 10 longitudinally downward and actuating the isolation valve 50. If only one power sub is used (bi-directional connection), then the shifting tool 100 may be raised or lowered depending on the last position of the isolation valve 50. Use of two-power subs 1 in the three-way configuration in conjunction with the uni-directional (downward) connection advantageously allows retrieval of the drill string in the event of emergency and/or malfunction of the power subs 1 and/or shifting tool 100 by simply pulling up on the drill string 1050.

Actuation of the power sub 1 may be verified by again detecting the indicator 15*l*. If the cleat 130 did not engage with the profile 10*p*, then detection of the indicator 15*i* may not occur because the indicator is out of range or the microprocessor 230 may detect that the indicator is further away than it should be. Once actuation has been verified, the microprocessor 230 may report to the surface. The rig 1000 may then send an instruction signal to the microprocessor to retract the cleat 130. The microprocessor may then close the control valve 152 and circulation may be halted, thereby allowing retraction of the cleat.

Alternatively, a second instruction signal may be sent to the telemetry sub via a second wireless medium and the microprocessor 230 may not operate the shifting tool until 100 receiving both instruction signals. Alternatively, the microprocessor may be programmed to autonomously extend the cleats in response to detection of the appropriate indicator(s) 15*p,l,h* and/or autonomously retract the cleats in response to detection of the appropriate indicator(s). Alternatively or additionally, the power sub 1 may further include one or more latches, such as collets or dogs, disposed between the housing and the mandrel. The latch may offer resistance to initial movement of the mandrel relative to the housing detectable at the surface and preventing unintentional actuation of the power sub due to incidental contact with other components of the drill string.

Figure 4A:
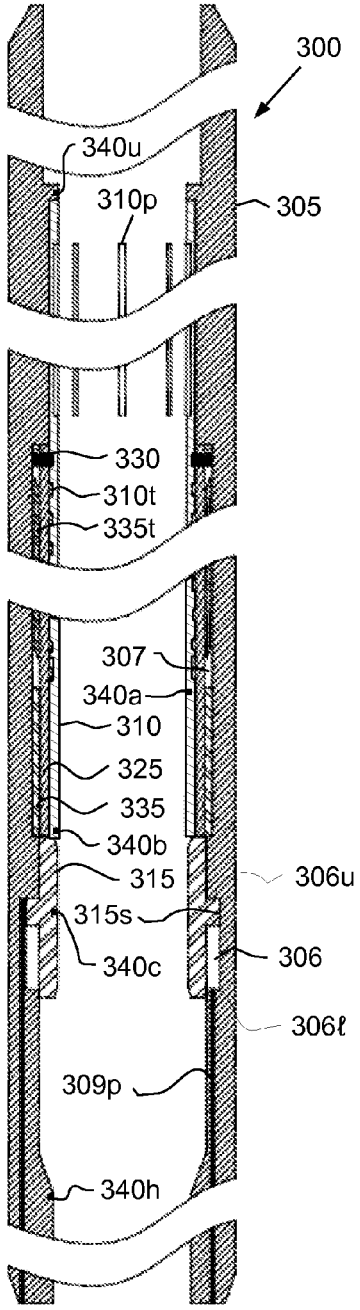
FIG. 4A illustrates a power sub for use with the isolation assembly, according to another embodiment of the present invention.

FIG. 4A illustrates a power sub 300 for use with the isolation assembly, according to another embodiment of the present invention. The power sub 300 may include a tubular housing 305, a tubular mandrel 310, a piston 315, a tubular driver 325, one or more indicators 340*a-c,u,h*, and a clutch 350. The housing 305 may have couplings (not shown) formed at each longitudinal end thereof for connection with the spacer sub 25, and other components of the casing/liner string. The couplings may be threaded, such as a box and a pin. The housing 305 may have a central longitudinal bore formed therethrough. Although shown as one piece, the housing 305 may include two or more sections to facilitate manufacturing and assembly, each section connected together, such as fastened with threaded connections.

The mandrel 310 may be disposed within the housing 305, longitudinally connected thereto, and rotatable relative thereto. The cleat 130 of the shifting tool 100 may be replaced by a rotational driver (not shown) and the mandrel 310 may have a profile 310*p* formed in an inner surface thereof for receiving the driver. The profile may be a series of slots 310*p* spaced around the mandrel inner surface. The slots 310*p* may have a length greater than or substantially greater than a length of the shifting tool driver to provide an engagement tolerance and/or to compensate for heave of the drill string 1050 for subsea drilling operations. The mandrel 310 may further have one or more helical profiles 310*t* formed in an outer surface thereof. If the mandrel 310 has two or more helical profiles 310*t* (two shown), then the helical profiles may be interwoven.

The piston 315 may be tubular and have a shoulder 315*s* disposed in a lower chamber 306 formed in the housing 305. The housing 305 may further have upper 306*u* and lower 306*l* shoulders formed in an inner surface thereof. The lower chamber 306 may be defined radially between the piston 315 and the housing 305 and longitudinally between an upper seal (not shown) disposed between the housing 305 and the piston 315 proximate the upper shoulder 306*u* and a lower seal (not shown) disposed between the housing 305 and the piston 315 proximate the lower shoulder 306*l*. A piston seal (not shown) may also be disposed between the piston shoulder 315*s* and the housing 305. Hydraulic fluid may be disposed in the lower chamber 306. Each end of the chamber 306 may be in fluid communication with a respective hydraulic coupling (not shown) via a respective hydraulic passage 309*p* formed longitudinally through a wall of the housing 305.

Two power subs 300 may be hydraulically connected to the isolation valve 50 in a three-way configuration such that each of the power sub pistons 315 are in opposite positions and operation of one of the power subs 300 will operate the isolation valve 50 between the open and closed positions and alternate the other power sub 300. This three way configuration may allow each power sub 300 to be operated in only one rotational direction and each power sub 300 to only open or close the isolation valve 50. Respective hydraulic couplings of each power sub 300 and the isolation valve 50 may be connected by a conduit, such as tubing (not shown).

FIGS. 4B-4E illustrate operation of the power sub 300. The helical profiles 310*t* and the clutch 350 may allow the driver 325 to longitudinally translate while not rotating while the mandrel 310 is rotated by the shifting tool and not translated. The clutch 350 may include a tubular cam 335 and one or more followers 330. The cam 335 may be disposed in an upper chamber 307 formed in the housing 305. The housing 305 may further have upper 307*u* and lower 307*l* shoulders formed in an inner surface thereof. The chamber 307 may be defined radially between the mandrel 310 and the housing 305 and longitudinally between an upper seal disposed between the housing 305 and the mandrel 310 proximate the upper shoulder 307*u* and lower seals disposed between the housing 305 and the driver 325 and between the mandrel 310 and the driver 325 proximate the lower shoulder 307*l*. Lubricant may be disposed in the chamber. A compensator piston (not shown) may be disposed in the mandrel 310 or the housing 305 to compensate for displacement of lubricant due to movement of the driver 325. The compensator piston may also serve to equalize pressure of the lubricant (or slightly increase) with pressure in the housing bore.

Each follower 330 may include a head 331, a base 333, and a biasing member, such as a coil spring 332, disposed between the head 331 and the base 333. Each follower 330 may be disposed in a hole 325*h* formed through a wall of the driver 325. The follower 330 may be moved along a track 335*t* of the cam 335 between an engaged position (FIGS. 4B and 4C), a disengaged position (FIG. 4E), and a neutral position (FIG. 4D). The follower base 333 may engage a respective helical profile 310*t* in the engaged position, thereby operably coupling the mandrel 310 and the driver 325. The head 331 may be connected to the base 333 in the disengaged position by a foot. The base 333 may have a stop (not shown) for engaging the foot to prevent separation.

The cam 335 may be longitudinally and rotationally connected to the housing 305, such as by a threaded connection (not shown). The cam 335 may have one or more tracks 335*t* formed therein. When the driver 325 is moving downward Md relative to the housing 305 and the mandrel 310 (from the piston upper position), each track 335*t* may be operable to push and hold down a top of the respective head 331, thereby keeping the base 333 engaged with the helical profile 310*t* and when the driver 325 is moving upward Mu relative to the housing 305 and the mandrel 310, each track 335*t* may be operable to pull and hold up a lip of the head 331, thereby keeping the base 333 disengaged from the helical profile 310*t*.

Figure 4B:
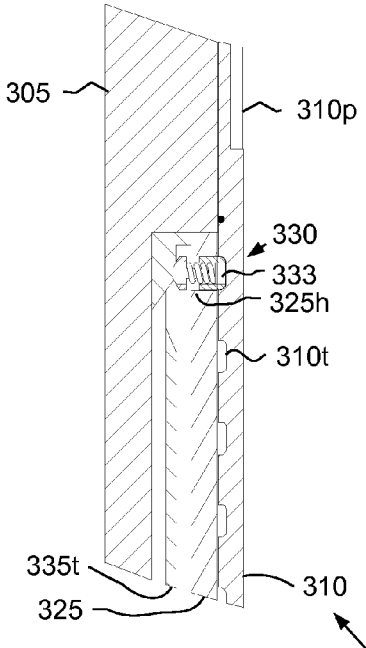
FIGS. 4B-4E illustrate operation of the power sub.
Figure 4D:
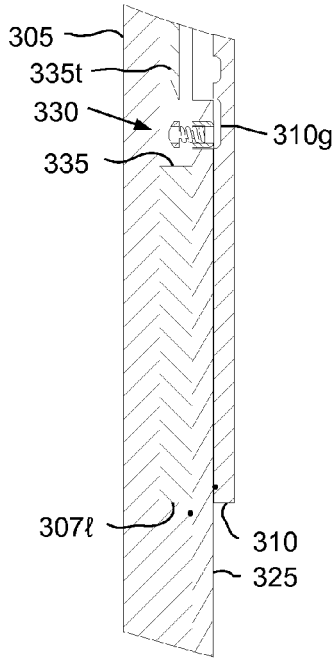
Figure 4C:
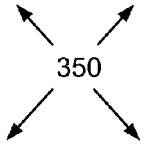
Figure 4C:
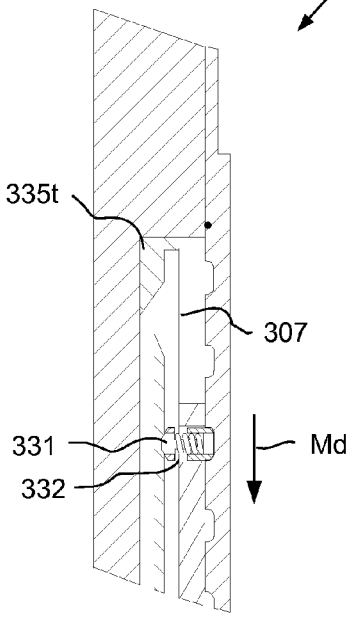
Figure 4E:
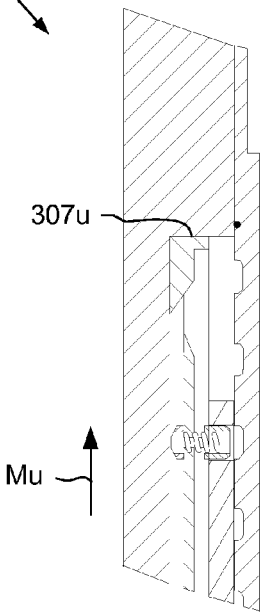

The driver 325 may be disposed between the mandrel 310 and the cam 335, rotationally connected to the cam 335, and longitudinally movable relative to the housing 305 between an extended position (FIGS. 4A and 4D) and a retracted position (FIG. 4B). A bottom of the driver 325 may abut a top of the piston 315, thereby pushing the piston 315 from an upper position (FIG. 4A) to a lower position when moving from the retracted to the extended positions. When the follower base 333 is engaged with the helical profile 310*t* (FIGS. 4B, 4C), rotation of the mandrel 310 by engagement with the shifting tool may cause longitudinal downward movement Md of the driver relative to the housing, thereby pushing the piston 315 to the lower position. This conversion from rotational motion to longitudinal motion may be caused by relative helical motion between the follower base 333 and the helical profile 310*t*.

Once the follower 330 reaches a bottom of the helical profile 310*t* and the end of the track, the follower spring 332 may push the head 331 toward the neutral position as continued rotation of the mandrel 310 may push the follower base 333 into a groove 310*g* formed around an outer surface of the mandrel 310, thereby disengaging the follower base 333 from the helical profile 310*t*. The follower 330 may float radially in the neutral position so that the base 333 may or may not engage the groove 310*g* and/or remain in the groove 310*g*. The groove 310*g* may ensure that the mandrel 310 is free to rotate relative to the driver 325 so that continued rotation of the mandrel 310 does not damage any of the shifting tool, the power sub 300, and the isolation valve 50.

Once the other power sub is operated by the shifting tool, fluid force may push the piston 315 toward the upper position, thereby longitudinally pushing the driver 325. The driver 325 may carry the follower 330 along the track 335*t* until the follower head 331 engages track 335*t*. As discussed above, the track 335*t* may engage the head lip and hold the base 333 out of engagement with the helical profile 310*t* so that the mandrel 310 does not backspin as the driver 325 moves longitudinally upward Mu relative thereto. Once the follower 330 reaches the top of the second longitudinal track portion, the follower head 331 may engage an inclined portion of the track 335*t* where the follower 330 is compressed until the base 333 engages the helical profile 310*t*.

The indicators 340*a-c,u,h* may each be passive RFID tags 250*p*. The indicators 340*u,h* may perform a similar function to the indicators 15*p,h* and the indicators 340*a-c* may perform a similar function to the indicator 15*l*. The indicator 340*c* may indicate movement of the piston 315 while the indicators 340*a,b* may be used to compensate for heave of the drill string (discussed above). The indicators 340*a-c,u,l* may further include a tool address to distinguish between the opener and closer power sub of the three-way configuration, discussed above.

Alternatively, the microprocessor may be programmed to autonomously extend the drivers in response to detection of the appropriate indicator(s) 340*a-c,u,h* and/or autonomously retract the drivers in response to detection of the appropriate indicator(s). Alternatively or additionally, the power sub 300 may further include one or more latches, such as collets or dogs, disposed between the piston and the housing. The latch may offer resistance to initial movement of the piston relative to the housing detectable at the surface and preventing unintentional actuation of the power sub due to incidental contact with other components of the drill string.

Figure 5:
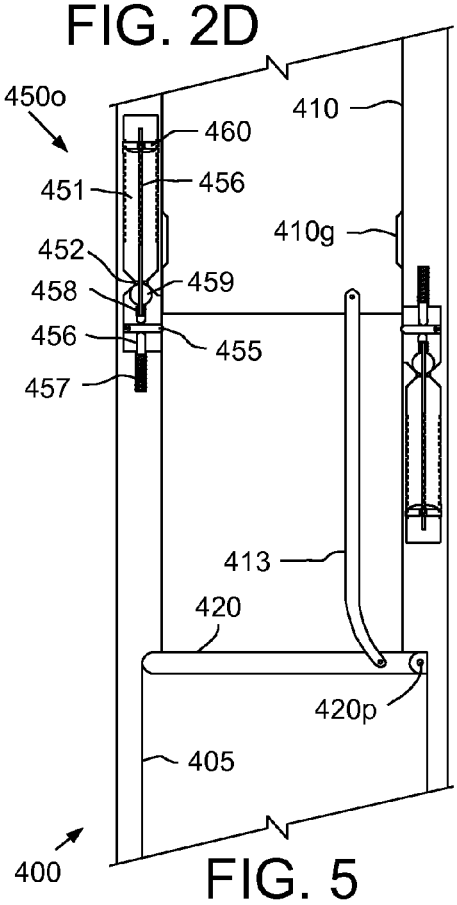
FIG. 5 illustrates a position indicator for the isolation valve, according to another embodiment of the present invention.

FIG. 5 illustrates one or more position indicators 450*o,c* for an isolation valve 400, according to another embodiment of the present invention. The isolation valve 400 may be similar to the isolation valve 50 and include a housing 405, a flow tube 410, a flapper 420, and a flapper pivot 420*p*. Relative to the isolation valve 50, an open indicator 450*o* and a closed 450*c* indicator have been added and the flow tube 410 has been modified. Instead of engaging the flapper 420, the flow tube 410 may be connected to the flapper by a linkage 413 fastened to a lower end of the flow tube and the flapper, such as by pivoting. As the flow tube 410 is moved longitudinally by the piston (not shown, see piston 61), the linkage 413 may push or pull on the flapper, thereby rotating the flapper to the open or closed position. The flapper spring may be omitted.

Each indicator 450*o,c* may include a chamber 451, a lever 455, a rod 456, one or more biasing members, such as a rod coil spring 457 and valve coil spring 458, a valve, such as a ball 459, and a piston, such as a disk 460. One or more RFID tags, such as passive tags 250*p* may be disposed in the chamber 451 and written with a message that the flapper is open. The chamber 451 may be formed in the housing and selectively isolated from the housing bore by the valve 459 engaging a seat 452 formed in the housing. Hydraulic fluid may be disposed in the chamber. The lever 455 may extend into the housing bore for engagement by a bottom of the flow tube 410. The lever 455 may be fastened to the housing 405, such as by pivoting. The rod 456 may be connected to the piston 460 and extend through the valve 459 and the lever 455. One or more seals (not shown) may be disposed between the piston 460 and the chamber 451. The rod 456 may be connected to the piston 460 by a ratchet and teeth such that the rod may move longitudinally upward relative to the piston but not downward.

In operation, as the flow tube 410 is being moved downward to open the flapper 420, the flow tube bottom may engage the lever 455 and rotate the lever about the pivot. The lever 455 may in turn push the rod 456 against the rod spring 457, thereby causing the rod to pull the piston 460 downward. Downward movement of the piston 460 may increase pressure in the chamber 451, thereby opening the valve 459 and expelling one of the RFID tags 250*p*. The RFID tag 250*p* may float upward and/or be carried upward by circulating drilling fluid 1045*f*. The RFID tag 250*p* may be read by the outer antenna 226*o* as the tag travels past the telemetry sub 200. The telemetry sub 200 may then report to the rig 1000. Alternatively or additionally, the tag 250*p* may be read at the rig 1000. As the flapper 420 completes opening, a groove 410*g* formed in an outer surface of the flow tube 410 may become aligned with the lever 455, thereby allowing the rod spring 457 to reset the lever. The disk 460 may remain in the advanced position due to operation of the ratchet mechanism. During this stroke, the closer lever 455 may move longitudinally downward; however, since the closer 450*c* may be reversed from the opener 450*o*, the ratchet mechanism may prevent movement of the closer piston 460, thereby ensuring that the closer remains idle. The closer 460*c* may be operated as the flapper 420 moves from the open to the closed position (having one or more tags 250*p* written with a message that the flapper is closed). Alternatively, instead of RFID tags 250*p*, colored balls (i.e., red for closed and green for open) may be disposed in the chambers 451 and observed at the rig 1000.

Figure 6A:
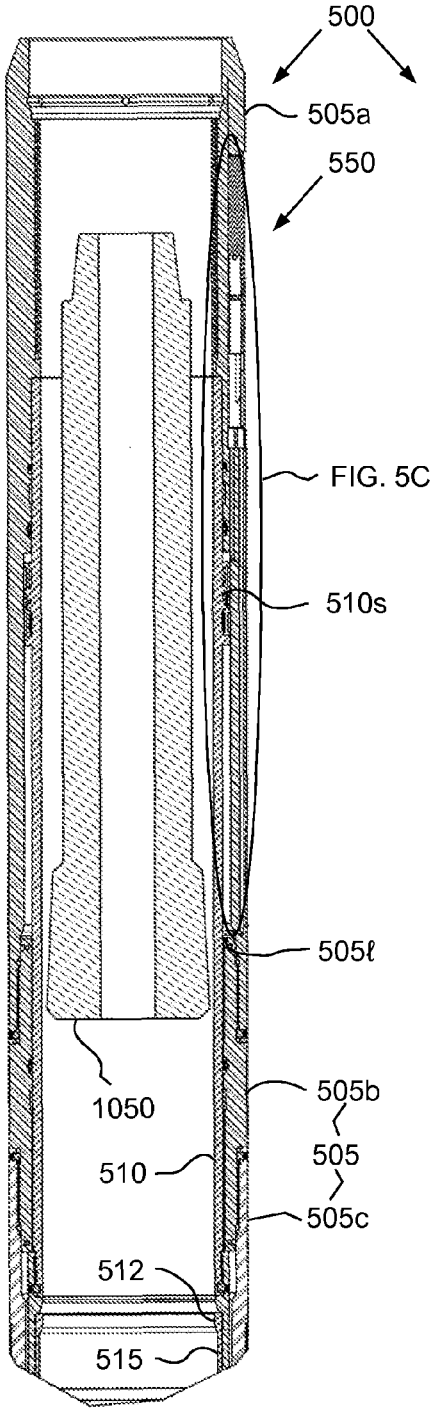
FIGS. 6A and 6B illustrate an isolation valve in the closed position, according to another embodiment of the present invention.
Figure 6B:
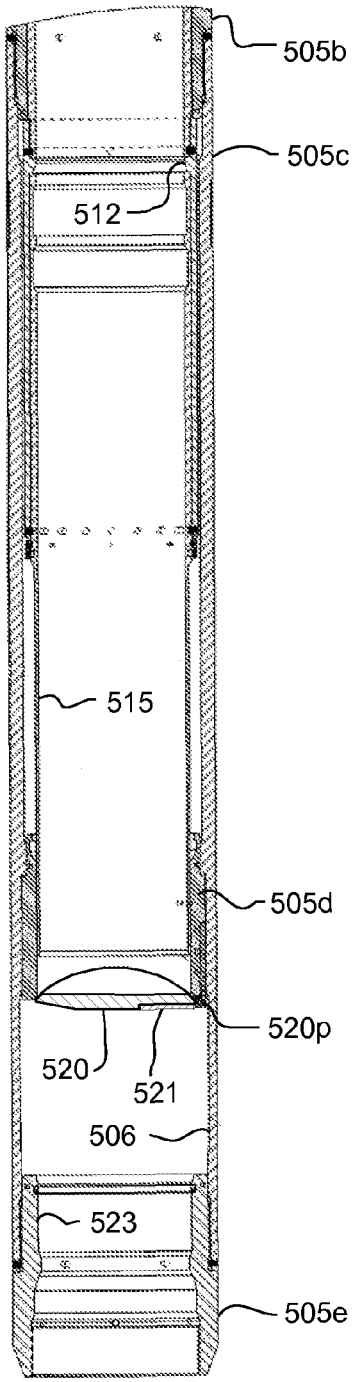
Figure 6C:
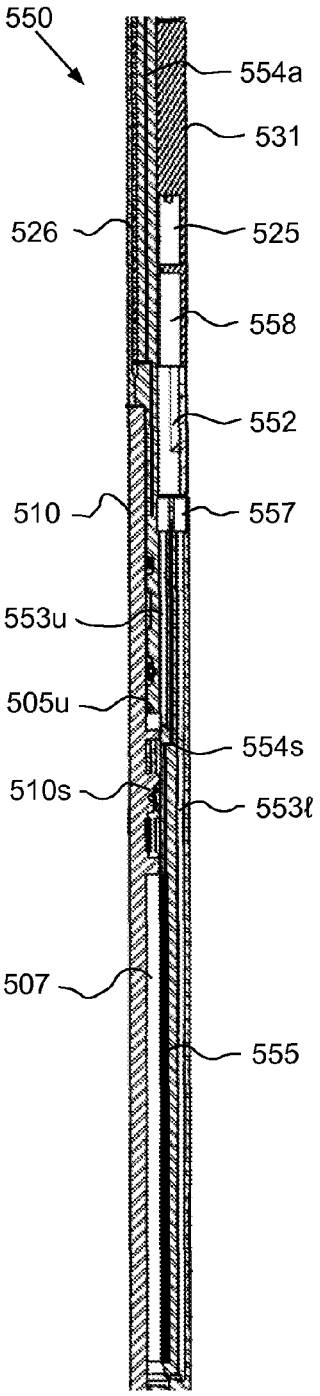
FIG. 6C is an enlargement of a portion of FIG. 6A.

FIGS. 6A and 6B illustrate an isolation valve 500 in the closed position, according to another embodiment of the present invention. FIG. 6C is an enlargement of a portion of FIG. 6A. The isolation valve 500 may include a tubular housing 505, a tubular piston 510, a flow tube 515, a closure member, such as the flapper 520, and an actuator 550. As discussed above, the closure member may be a ball (not shown) instead of the flapper 520. To facilitate manufacturing and assembly, the housing 505 may include one or more sections 505*a-e* each connected together, such as fastened with threaded connections and/or fasteners. The housing 505 may further include an upper adapter (not shown) connected to section 505*a* and a lower adapter (not shown) connected to the section 505*e* for connection as part of the casing or liner. The housing 505 may have a longitudinal bore formed therethrough for passage of a drill string.

The piston 510 and the flow tube 515 may each be disposed within the housing 505. Each of the piston 510 and the flow tube 515 may be longitudinally movable relative to the housing 505. The piston 510 and the flow tube 515 may be connected together, such as by coupling 512. Each of the piston 510 and the flow tube 515 may be fastened to the coupling 512, such as by threads and/or fasteners. The piston 510 may have a shoulder 510*s* formed in an outer surface thereof. The shoulder 510*s* may carry one or more seals for engaging an inner surface of a chamber 507 formed in the housing 505. The housing 505 may have upper 505*u* and lower 505*l* shoulders formed in an inner surface thereof. The chamber 507 may be defined radially between the piston 510 and the housing 505 and longitudinally between an upper seal disposed between the housing 505 and the piston 510 proximate the upper shoulder 505*u* and a lower seal disposed between the housing 505 and the piston 510 proximate the lower shoulder 505*l*. Hydraulic fluid may be disposed in the chamber 507. Each end of the chamber 507 may be in fluid communication with the actuator 550 via a respective hydraulic passage 553*u,l* formed through a wall of the housing 505.

The flow tube 515 may be longitudinally movable by the piston 510 between the open position and the closed position. In the closed position, the flow tube 515 may be clear from the flapper 520, thereby allowing the flapper 520 to close. In the open position, the flow tube 515 may engage the flapper 520, push the flapper 520 to the open position, and engage a seat 523 formed in the housing 505. Engagement of the flow tube 515 with the seat 523 may form a chamber 506 between the flow tube 515 and the housing 505, thereby protecting the flapper 520 and the flapper seat 522. The flapper 520 may be pivoted to the housing 505, such as by a fastener 520*p*. A biasing member, such as a torsion spring 521 may engage the flapper 520 and the housing 505 and be disposed about the fastener 520*p* to bias the flapper 520 toward the closed position. In the closed position, the flapper 520 may fluidly isolate an upper portion of the valve from a lower portion of the valve.

The actuator 550 may include an electronics package 525, a battery 531, an antenna 526, an electric motor 558, a hydraulic pump 552, and a position sensor 555. The electronics package 525 and the antenna 526 may be similar to the electronics package 225 and the antenna 226*i*, respectively. The pump 552 may be in communication with the passages 553*u,l* and operable to hydraulically move the shoulder 510*s* longitudinally between the closed position and the open position. The pump 552 may include a piston and cylinder and connected to the motor 558 by a nut and lead screw. Alternatively, the motor 558 may be a linear motor instead of a rotary motor. Additionally, the actuator 550 may include a solenoid operated valve 557 or solenoid operated latch for locking the valve at the open and closed positions to prevent unintentional actuation of the valve due to incidental contact with the drill string.

The electric motor 558 may drive the hydraulic pump 552 by receiving electricity from the microprocessor. The microprocessor may supply the electricity at a first polarity to open the flapper 520 and at a second reversed polarity to close the flapper 520. The position sensor 555 may be able to detect when the piston is in the open position, the closed position, or at any position between the open and closed positions so that the microprocessor may detect full or partial opening of the valve. The position sensor 555 may be a Hall sensor and magnet or a linear voltage differential transformer (LVDT). The position sensor 555 may be in electrical communication with the microprocessor via leads 554*s*. The microprocessor may use the position sensor 555 to determine when the piston shoulder 510*s* has reached the open or closed position to shutoff the motor 558 and close the valve 557. The antenna 526 may be bonded or fastened to an inner surface of the housing 505 and in electromagnetic communication with the housing bore. The antenna 526 may be in electrical communication with the microprocessor via leads 554*a*. The electronics package 525, the motor 558, the pump 552, and the valve 557 may be molded into a field replaceable unit and be fastened to a recess formed in an outer surface of the housing 505.

In operation, to open or close the valve 500, an RFID instruction tag, such as the passive tag 250*p* may be pumped through the drill string 1050 and exit the drill string 1050 via the drill bit 1050*b*. The tag 250*p* may then be carried up the annulus 1025 until the tag is in range of the antenna 526. The microprocessor may read the command encoded in the tag 250*p*, such as to open the valve. The microprocessor may then open the valve 557 and operate the motor 558, thereby moving the piston shoulder 510*s* and the flow tube 515 into engagement with the flapper 520. The microprocessor may then detect that the flapper 520 has opened. A verification RFID tag, such as the WISP tag 250*w*, may then be pumped through the drill string 1050 and return up the annulus 1025. The WISP tag 250*w* may inquire about the position of the flapper 520 (as indirectly measured by the position sensor 555). The microprocessor may then respond that the flapper 520 is open or respond with an error message if the actuator 550 malfunctioned and did not open the flapper 520. The WISP tag 250*w* may record the response and continue to the rig 1000 where a surface reader may retrieve the information from the tag 250*w*. The error message may include the position of the piston shoulder 510*s* (the drilling operation may continue even if the flapper 520 is open but not completely covered by the flow tube 515). Closing of the flapper may be similar to the opening operation. Additionally, the WISP tag 250*w* may inquire and record a charge level of the battery.

Alternatively, instead of pumping tags to communicate with the isolation valve 500, the telemetry sub 200 may be included in the drill string 1050 and used to send the instruction signal to the valve microprocessor and receive the status information. The telemetry sub 200 may then communicate the status information to the rig 1000. Alternatively, the piston 510 may be a mandrel having gear teeth formed along an outer surface thereof and the pump 552 may be replaced by a gear connecting the motor 558 to the mandrel. Alternatively, instead of pumping tags to communicate with the isolation valve 500, the electronics package 525 may include a vibration sensor in communication with the microprocessor and the instruction signal may be sent to the microprocessor by striking the casing according to a predetermined protocol. The striker may be located at surface (i.e., in the wellhead) and operated by the rig controller.

Figure 7A:
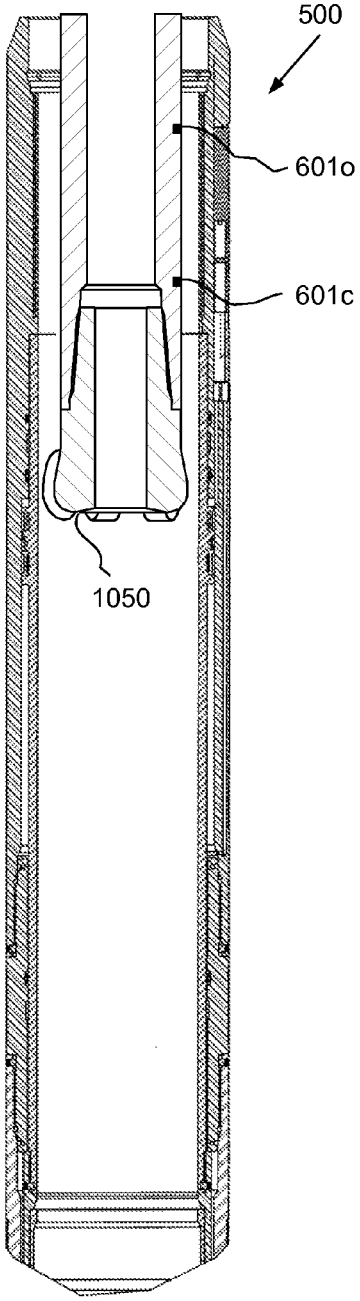
FIG. 7A illustrates another way of operating the isolation valve, according to another embodiment of the present invention.

FIG. 7A illustrates another way of operating the isolation valve 500, according to another embodiment of the present invention. Instead of pumping the tags through the drill string 1050, two or more tags 601*o,c*, such as passive tags 250*p*, may be embedded in an outer surface of the drill string 1050. The tags 601*o,c* may be embedded in an outer surface of the drill bit 1050*b*, a portion of the drill string 1050 near the drill bit, such as a drill collar, or a portion of the drill string farther away from the drill bit, such as the first joint of drill pipe connected to the drill collar. The tags 601*o,c* may spaced a sufficient distance so that the tags are not simultaneously in range of the antenna 526. The tag 6010 may be written with the open command and the tag 601*c* may be written with the close command. As the drill string 1050 is lowered into range of the antenna 526, the microprocessor may read the close command first from the tag 601*c* and simply ignore the command since the microprocessor knows the valve 500 is already closed. The microprocessor may then read the open command from the tag 6010 and open the valve 500. Conversely, when retrieving the drill string 1050 from the wellbore 1005 (flapper 520 is open), the microprocessor may read the open command first and ignore the command since the microprocessor knows that the valve 500 is already open. The microprocessor may then read the closed command and close the flapper 520 accordingly. If, as discussed below, the casing 1015 has been cemented with the flapper 520 open, the flapper may close when the actuator 550 receives the close command and then open when the actuator receives the open command.

Alternatively, each of the tags 601*o,c* may be disposed in a fastener, such as a snap ring (not shown), fastened to an outer surface of the drill string. Each snap ring may include a plurality of open 6010 or close 601*c* tags spaced therearound for redundancy. Each tag may be bonded in a recess formed in an outer surface of the snap ring, such as by epoxy. Each snap ring may be made from a hard material to resist erosion during drilling, such as tool steel, ceramic or cermet. Alternatively, an upper portion of the valve 500 including the actuator 550 and the piston 510 may be a power sub split from a lower portion of the valve including the flapper and the flow tube by a spacer sub. In this alternative, the flow tube may include a piston shoulder in communication with the piston. Alternatively, each of the tags 601*o,c* may instead be WISP tags 250*w* and may record a position and/or status of the battery of the valve to be read when the drill string is retrieved at the rig 1000.

Figure 7E:
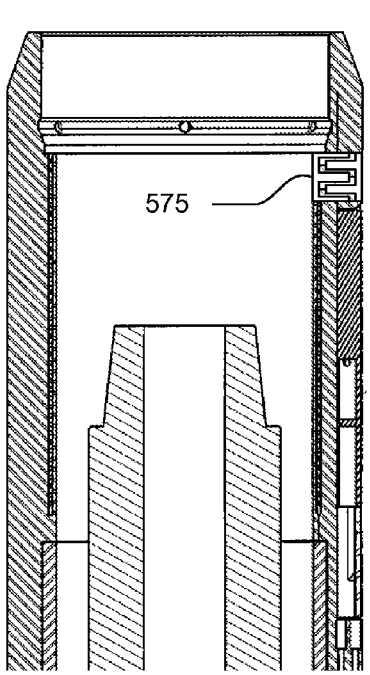
FIG. 7E illustrates another charger for use with an isolation valve, according to another embodiment of the present invention.
Figure 7F:
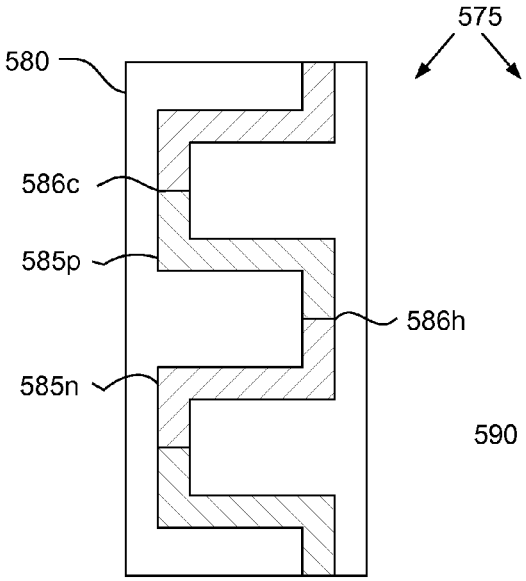
FIG. 7F is an enlargement of the charger.
Figure 7G:
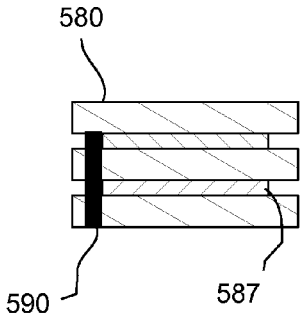
FIG. 7G is a cross-section illustrating two layers of the charger.
Figure 7B:
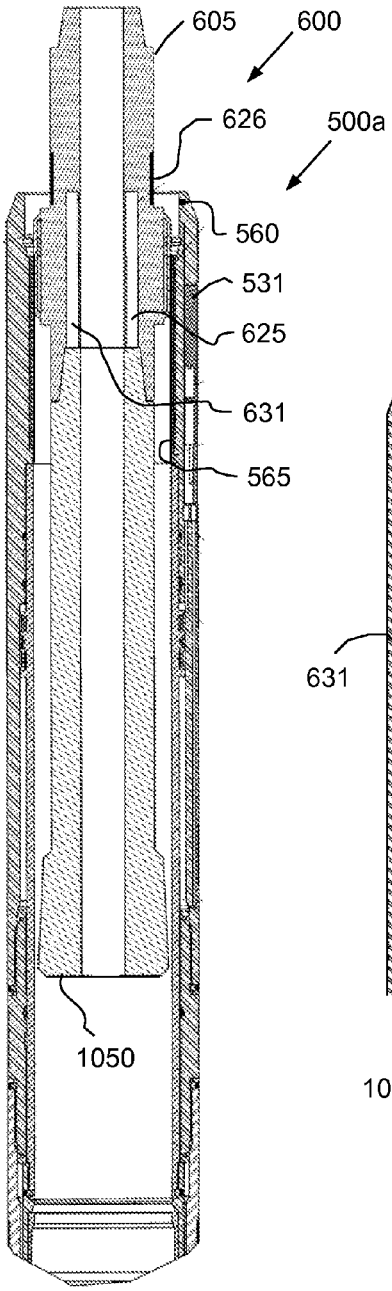
FIG. 7B illustrates a charger for use with an isolation valve, according to another embodiment of the present invention.

FIG. 7B illustrates a charger 600 for use with an isolation valve 500*a*, according to another embodiment of the present invention. FIG. 7C is an isometric view of the charger 600. In the event that the battery 531 of the actuator 550 becomes depleted, a charger 600 may be added to the drill string 1050. The charger 600 may include a tubular housing 605 having threaded couplings formed at each longitudinal end thereof for connection with other components of the drill string 1050. The housing 605 may include one or more sections (only one section shown) to facilitate manufacturing and assembly, each section connected together, such as fastened with threaded connections. The housing 605 may have a longitudinal bore formed therethrough and one or more compartments formed in a wall thereof. An electronics package 625 (similar to the electronics package 225) and a battery 631 may each be disposed in a respective compartment. The charger microprocessor and the battery 631 may be in electrical communication via internal leads (not shown). An antenna 626 (similar to the antenna 226*o*) may be disposed around an outer surface of the charger housing 605.

The valve 500*a* may be similar to the valve 500 except that an indicator 560, such as a passive RFID tag 250*p*, may be embedded in an inner surface of the valve housing 505 and a sleeve 565 may be added over the valve antenna 526. The sleeve 565 may be fastened to the valve housing 505, such as by a threaded connection. The sleeve 565 may be made from an electrically conductive, non-magnetic metal or alloy, such as a copper, copper alloy, aluminum, aluminum alloy, or stainless steel. The sleeve 565 may be split into two poles by a dielectric material (not shown). The sleeve 565 may be in electrical communication with the valve microprocessor via leads (not shown). The indicator 560 may be located near the valve antenna 526.

One or more ribs 605*r* may be formed in an outer surface of the housing 605 and spaced therearound. A contact, such as a leaf spring 607, may be fastened to the housing 605 and extend from each rib 605*r*. Each contact 607 may be in electrical communication with the charger microprocessor via internal leads (not shown). In operation, the charger microprocessor may detect the indicator 560 and respond by supplying DC electricity from the battery 631 to two of the contacts 607. Opposite polarity may be supplied to the other two contacts 607. The resulting current may flow through the contacts 607 and the sleeve 565 to the valve microprocessor. The electricity may also charge the valve battery 531. The charger microprocessor and the valve microprocessor may also communicate via the contacts 607 and the sleeve 565. The charger microprocessor may periodically query the valve microprocessor for a battery charge status and periodically query the indicator 560. The microprocessor may shutoff electricity when the valve battery 531 is fully charged or when the indicator 560 is out of range of the charger antenna 626. During or after charging, a command RFID tag 250*p* may be pumped through the drill string 1050 to open or close the flapper 520.

Alternatively, the contacts 607 may be replaced the antenna 626 the sleeve 565 may be omitted. The antenna 626 may be used to charge the valve battery via inductive coupling between the antenna 626 and the valve antenna 526 or a coil may be added to the valve for charging. Alternatively, a capacitor (not shown) may be used instead of the battery 531. The capacitor may then be charged each time it is desired to open or close the valve 500. The capacitor may also be used in addition to the battery 531 as a backup in case the battery fails. Additionally, the charger 600 may include the mud pulser 275 for reporting to the drilling rig and/or the tachometer 255 and the pressure sensor 204 for receiving valve instruction signals from the drilling rig and relaying the signals to the isolation valve instead of pumping RFID tags to send the signals.

Figure 7D:
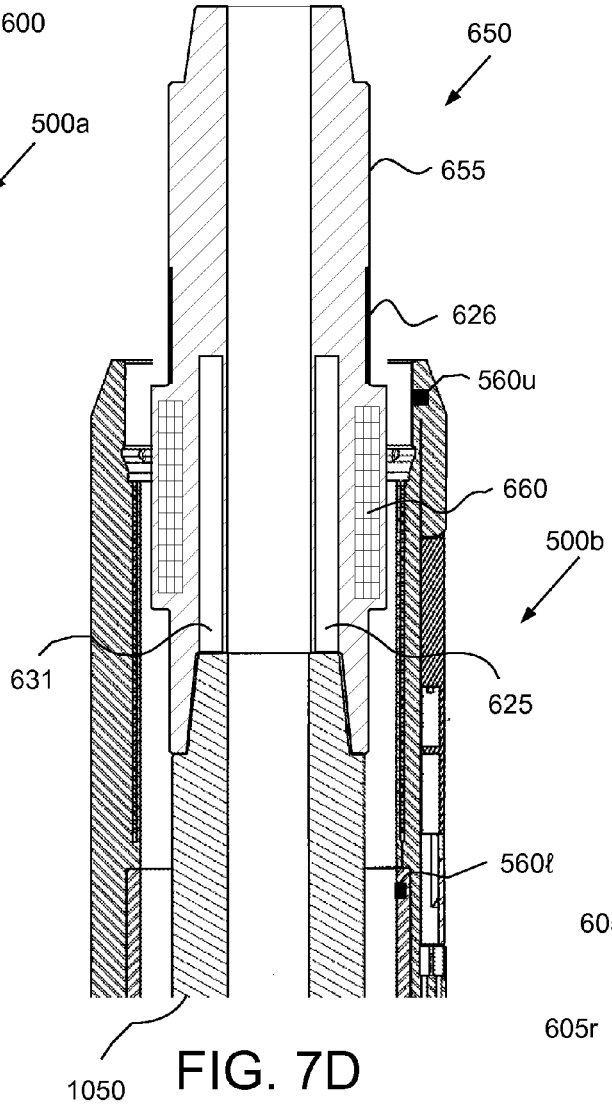
FIG. 7D illustrates another charger for use with an isolation valve, according to another embodiment of the present invention.
Figure 7C:
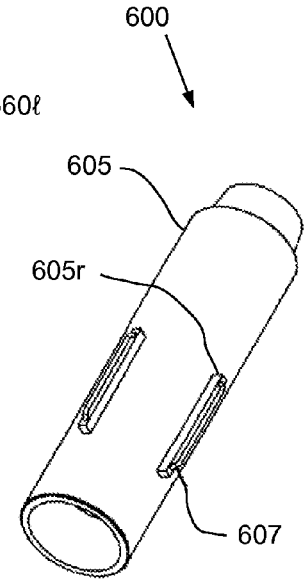
FIG. 7C is an isometric view of the charger of FIG. 7B.

FIG. 7D illustrates another charger 650 for use with an isolation valve 500*b*, according to another embodiment of the present invention. The valve 500*b* may be similar to the valve 500 except that indicators 560*u,l*, such as passive RFID tags 250*p*, may be embedded in an inner surface of the valve housing 505 and an inner surface of the piston 510. The charger 650 may include a tubular housing 655 having threaded couplings formed at each longitudinal end thereof for connection with other components of the drill string 1050. The housing 655 may include one or more sections (only one section shown) to facilitate manufacturing and assembly, each section connected together, such as fastened with threaded connections. The housing 655 may have a longitudinal bore formed therethrough and one or more compartments formed in a wall thereof. The electronics package 625 and the battery 631 may each be disposed in respective compartments. The charger microprocessor and the battery 631 may be in electrical communication via internal leads (not shown). The antenna 626 may be disposed around an outer surface of the charger housing 605.

The charger 650 may be similar to the charger 600 except that instead of the contacts 607, the charger 650 may include one or more electromagnets 660. The electromagnet 660 may be disposed in an outer compartment formed in the housing 655 and include a winding. The winding 660 may include wire or strap wound around an inner surface of the housing 655 into a helical spiral and made of conductive material, such as aluminum, copper, aluminum alloy, or copper alloy. Each turn of the spiral may be electrically isolated by a dielectric material, such as tape, or the conductive material may instead be anodized. The winding 660 may be isolated from the housing 655 by the dielectric material. The housing 655 may be made from a ferromagnetic material, such as a metal or alloy, such as steel, to serve as a core of the electromagnet 660. Alternatively, the electromagnet 660 may include one or more toroidal windings disposed in the housing compartment. Each toroidal winding may include a winding wound around a core ring made from the ferromagnetic material and the housing may be made from the ferromagnetic material or a nonmagnetic material.

In operation, as the drill string 1050 is being longitudinally raised or lowered through the isolation valve 500*b*, the charger microprocessor may read a respective indicator tag 560*u,l*. The charger microprocessor may then supply DC electricity from the battery 631 to the electromagnet 660. As the electromagnet 660 is longitudinally raised or lowered by the valve antenna 526, a DC voltage (electromotive force) may be generated in the antenna according to Faraday's law (analogous to a Faraday (shake charge) flashlight). The resulting electricity may charge the valve battery 531. The charger microprocessor may continue to supply electricity to the electromagnet 660 until the microprocessor detects the other indicator tag 560*u,l*. The microprocessor may then shutoff the electricity to the electromagnet 660 so that the electromagnet does not attract cuttings during drilling. The charger microprocessor may switch polarity supplied to the electromagnet based on which indicator is detected first, thereby obviating need for the valve electronics 525 to include a rectifier. A status tag 250*w* may then be circulated through the drill string 1050 to obtain a charge status of the valve battery. If a single pass of the drill string 1050 is insufficient to charge the valve battery 531, then the drill string may be reciprocated in the valve 500 until the valve battery is fully charged.

Alternatively, a plurality of chargers 650 may be distributed along the drill string 1050 at regular intervals, such as one every thousand feet so that as the wellbore 1005 is being drilled or the drill string is being retrieved, the valve battery 531 intermittently receives a charge.

FIG. 7E illustrates another charger 575 for use with an isolation valve 500*c*, according to another embodiment of the present invention. FIG. 7F is an enlargement of the charger 575. FIG. 7G is a cross-section illustrating two layers 587 of the charger 575. Except for the addition of the charger 575, the valve 500*c* may be similar to the valve 500. The charger 575 may be a thermoelectric generator and may include a substrate 580 made of thermally insulating dielectric such as, a ceramic wafer having a microporous structure, one face of which carries n-type 585*n* and p-type 585*p* semiconductor elements.

The semiconductor elements 585*n,p* may be placed alternately and connected electrically in series to one another in order to form thermocouples 586*c,h* at their junctions. Each element 585*n,p* may include a straight bar portion that extends transversely to the longitudinal direction of the substrate 580 and two perpendicular bars opposing each other and located at respective ends of the straight bar portion, thereby forming a Z-shaped element. Each element 585*n,p* may be made from a thin film of n-type doped or p-type doped polycrystalline semiconductor ceramic. The junctions formed between the semiconductor elements 585*n,p* may alternate from one side of the longitudinal mid-axis of the substrate 580 to the other, to form the respective hot 586*h* and cold 586*c* junctions of the thermocouples. The materials of the substrate 580 and of the semiconductor elements 585*n,p* may be chosen so as to have compatible thermal expansion coefficients so as to avoid high thermal stresses in the components of the generator 575 during its use.

The generator 575 may include one or more layers 587 stacked in such a way that the semiconductor elements 585*n,p* carried by a substrate 580 are covered by another substrate 580 of the same type and of the same size. Each semiconductor element 585*n,p* of each layer 587 may be thermally connected to the substrates 580 in parallel with the other elements of the layer. Each layer 587 may be thermally connected in parallel with the other layers. The number of substrates 580 may be one greater than that of the components, so that the semiconductor elements of all the components are covered by a dielectric substrate 580. The generator may include electrical connections, such as two connecting bands 590 (only one shown), made from electrically conductive material. Each band 590 may connect ends of cold junctions 586*c* of the layers electrically in either series or parallel and the internal leads may connect the bands to the microprocessor and/or battery 531. The thermal generator 575 may be bonded or fastened to an inner surface of the housing 505 and connected to the microprocessor and/or battery via internal leads (not shown).

In operation, an outer surface of the valve 500*c* may be at an ambient wellbore temperature. To charge the battery 531, drilling fluid 1045*f* having a temperature less or substantially less than the ambient wellbore temperature may be pumped through the drill string 1050 and into the annulus 1025, thereby inducing a temperature gradient across the generator 575. Due to the Peltier-Seebeck effect, a voltage may be generated by the semiconductor elements 585*n,p*, thereby charging the battery 531. The temperature gradient between the drilling fluid 1045*f* at ambient surface temperature and the wellbore temperature may be sufficient to charge the battery 531.

Figure 8A:
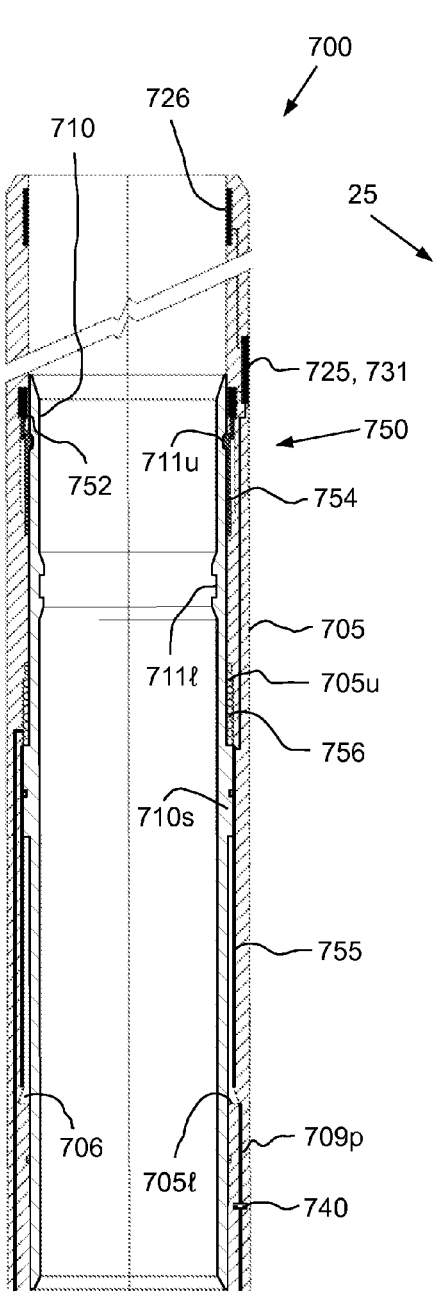
FIGS. 8A-C illustrate another isolation assembly in the closed position, according to another embodiment of the present invention.
Figure 8B:
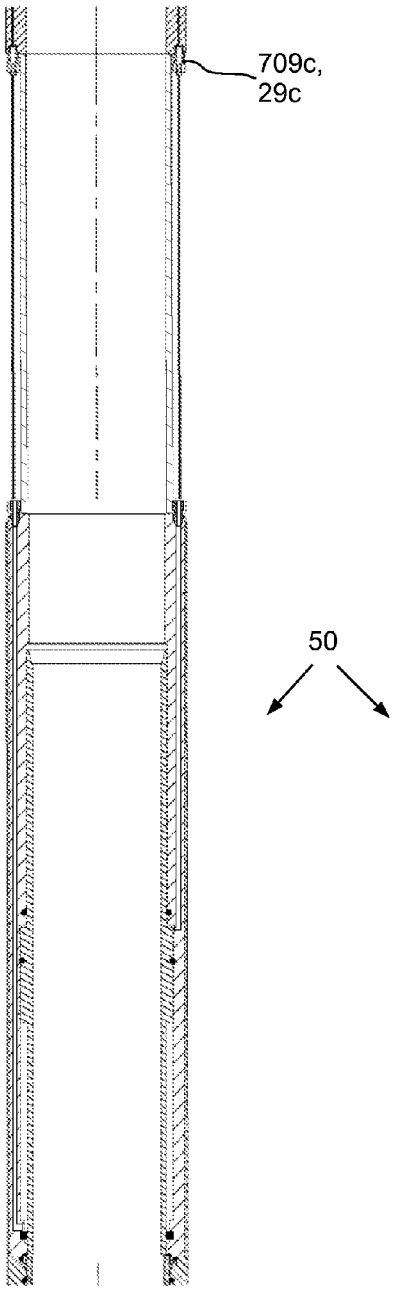
Figure 8C:
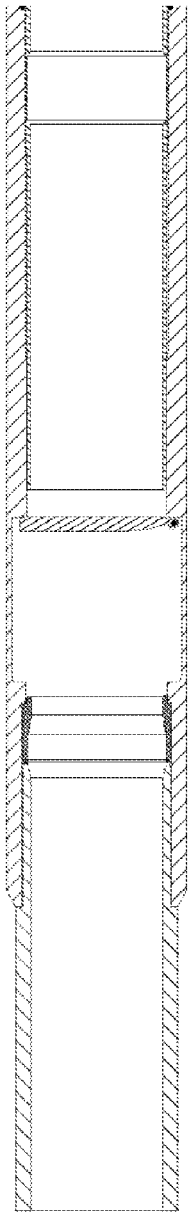

FIGS. 8A-C illustrate another isolation assembly in the closed position, according to another embodiment of the present invention. The isolation assembly may include a power sub 700, the spacer sub 25, and the isolation valve 50. The isolation assembly may be assembled as part of a casing 1015 or liner string and run-into the wellbore 1005. The casing 1015 or liner string may be cemented in the wellbore 1005 or be a tie-back casing string.

The power sub 700 may include a tubular housing 705, a tubular mandrel 710, and an actuator 750. The housing 705 may have couplings (not shown) formed at each longitudinal end thereof for connection with other components of the casing/liner string. The couplings may be threaded, such as a box and a pin. The housing 705 may have a central longitudinal bore formed therethrough. Although shown as one piece, the housing 705 may include two or more sections to facilitate manufacturing and assembly, each section connected together, such as fastened with threaded connections.

The mandrel 710 may be disposed within the housing 705 and longitudinally movable relative thereto between an upper position (shown) and a lower position. The mandrel 710 may have a lower profile 711*l* formed in an inner surface thereof for receiving a cleat of a shifting tool (not shown). The shifting tool may be similar to the shifting tool 100 except that the actuator 150 may be omitted and a seat may be formed in an inner surface of the shifting tool mandrel for receiving a blocking member, such as a ball 1090 (FIG. 11A), deployed through the drill string 1050 for operation thereof. The ball 1090 may be deployed by pumping or dropping. Although not shown, the mandrel 710 may further have one or more position indicators similar to the indicators 15*p,l,h*, discussed above. The mandrel 710 may further have a piston shoulder 710*s* formed in or fastened to an outer surface thereof. The piston shoulder 710*s* may be disposed in a chamber 706. The housing 705 may further have upper 705*u* and lower 705*l* shoulders formed in an inner surface thereof. The chamber 706 may be defined radially between the mandrel 710 and the housing 705 and longitudinally between an upper seal disposed between the housing 705 and the mandrel 710 proximate the upper shoulder 705*u* and a lower seal disposed between the housing 705 and the mandrel 710 proximate the lower shoulder 705*l*. Hydraulic fluid may be disposed in the chamber 706. Each end of the chamber 706 may be in fluid communication with a respective hydraulic coupling 709*c* via a respective hydraulic passage 709*p* formed longitudinally through a wall of the housing 705.

The actuator 750 may include an antenna 726, an electronics package 725, a battery 731, a lock 752, a latch 754, a position sensor 755 and a biasing member, such as a coil spring 756. The antenna 726 and electronics package 725 may be similar to the antenna 226*i* and the electronics package 225, respectively. The spring 756 may be disposed in the chamber 706 against the upper shoulder 705*u* and a top of the shoulder 710*s*, thereby biasing the mandrel 710 toward the lower position where the valve 50 is open. The mandrel 710 may be selectively restrained in the upper position (where the valve 50 is closed) by the latch 754 and the lock 752. The latch 754 may be a collet connected to the housing, such as being fastened. The collet may include a base ring and two or more radially split fingers. The mandrel 710 may have an upper profile 711*u* formed in an outer surface thereof for receiving the fingers, thereby longitudinally connecting the mandrel 710 and the housing 705. The fingers may be biased into engagement with the profile 711*u*. The spring bias may be sufficient to drive the collet fingers from the upper profile 711*u*.

The lock 752 may include a linear actuator, such as a linear motor, and a sleeve longitudinally movable relative to the housing by the linear actuator between a locked position and an unlocked position. The sleeve may engage an outer surface of the collet fingers in the locked position, thereby keeping the fingers from radially moving out of the upper profile. The sleeve may be clear of the fingers in the unlocked position, thereby allowing the collet fingers to radially move out of the upper profile. The linear actuator may be fastened to the housing and be in electrical communication with the electronics package 725 via internal leads. The position sensor 755 may be a Hall sensor and magnet or a linear voltage differential transformer (LVDT). The position sensor 755 may be in electrical communication with the microprocessor via leads. The microprocessor may use the position sensor 755 to determine when the upper profile is aligned with the collet fingers to extend the sleeve and lock the collet fingers in the profile. The microprocessor may also use the position sensor to verify that the valve has opened. The antenna 726 may be bonded or fastened to an inner surface of the housing 705 and in electromagnetic communication with the housing bore. The antenna 726 may be in electrical communication with the microprocessor via leads.

In operation, to open the valve 50, an RFID instruction tag, such as the passive tag 250*p* may be pumped through the drill string 1050 and exit the drill string via the drill bit 1050*b*. The tag 250*p* may then be carried up the annulus 1025 until the tag is in range of the antenna 726. The microprocessor may read the command encoded in the tag 250*p*, such as to open the valve. The microprocessor may move the sleeve to the unlocked position by supplying electricity to the linear actuator, thereby allowing the spring 756 to move the piston shoulder 710*s* longitudinally downward and open the valve 50. Movement of the piston shoulder 710*s* may be damped by a damper, such as an orifice 740, disposed in the passage 709*p*. The microprocessor may then detect that the valve 50 has opened. A verification RFID tag, such as the WISP tag 250*w*, may then be pumped through the drill string 1050 and return up the annulus 1025. The WISP tag 250*w* may inquire about the position of the valve 50. The microprocessor may then respond that the flapper 70 is open or respond with an error message if the actuator 750 malfunctioned and did not open the valve 50. The WISP tag 250*w* may record the response and continue to the rig 1000 where a surface reader may retrieve the information from the tag 250*w*. The error message may include the position of the piston shoulder 710*s* (the drilling operation may continue even if the flapper 70 is open but not completely covered by the flow tube 60). Additionally, the WISP tag 250*w* may inquire and record a charge level of the battery.

To close the valve 50 after a drilling operation, the drill string 1050 may raised until the shifting tool cleat is aligned or nearly aligned with the lower profile 711*l*. An RFID instruction tag, such as the passive tag 250*p*, may be pumped through the drill string 1050 and exit the drill string via the drill bit 1050*b*. The tag 250*p* may then be carried up the annulus 1025 until the tag is in range of the antenna 726. The microprocessor may read the command encoded in the tag 250*p*, such as to close the valve 50. The microprocessor may supply electricity to the linear actuator, thereby unlocking the sleeve. The ball 1090 may then be launched from the rig 1000 and pumped down through the drill string 1050 until the ball lands on the shifting tool seat. Continued pumping may exert fluid pressure on the ball 1090, thereby driving the shifting tool mandrel longitudinally downward and moving the shifting tool inner slips relative to the outer slips. Once the ball 1090 has landed and the slips have operated, pumping may be halted and pressure maintained. The shifting tool fasteners may be wedged outward by the relative longitudinal movement of the slips. The shifting tool fasteners may push the cleat into engagement with an inner surface of the mandrel 710. If the cleat is misaligned with the lower profile 711*l*, then the shifting tool may be raised and/or lowered until the cleat is aligned with the profile. The shifting tool leaf spring may allow the cleat to be pushed inward by the profile during engagement of the profile with the cleat. Engagement of the cleat with the profile 711*l* may longitudinally connect the shifting tool and the mandrel 710. The shifting tool may be raised thereby raising the mandrel 710 against the spring 756 until the collet fingers are aligned with and engage the profile 711*u*. The microprocessor may detect engagement using the position sensor and shutoff electricity to the microprocessor, thereby locking the sleeve.

Alternatively, the embedded tags 601*o,c* may be used to send the open and/or closed commands. Additionally, any of the chargers 600, 650, 575 may be used to charge the battery 731 and a capacitor may be used instead of or in addition to the battery as discussed above.

Figure 9A:
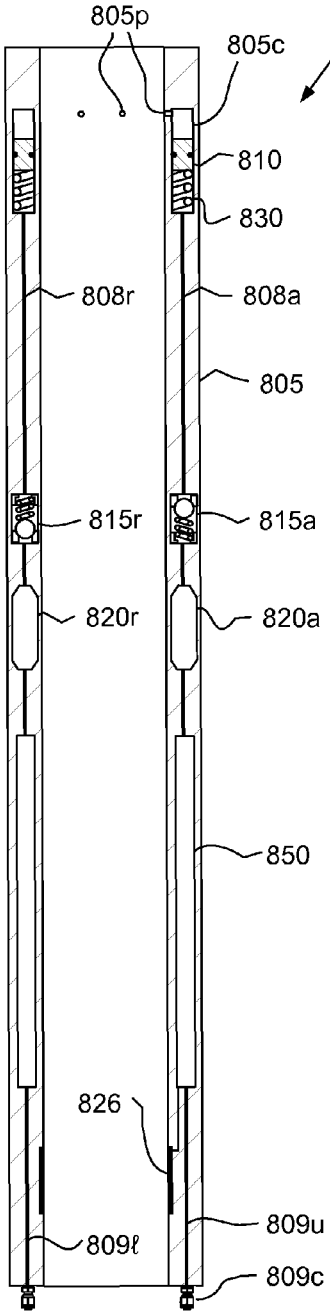
FIGS. 9A-C illustrate another isolation assembly in the closed position, according to another embodiment of the present invention.
Figure 9B:
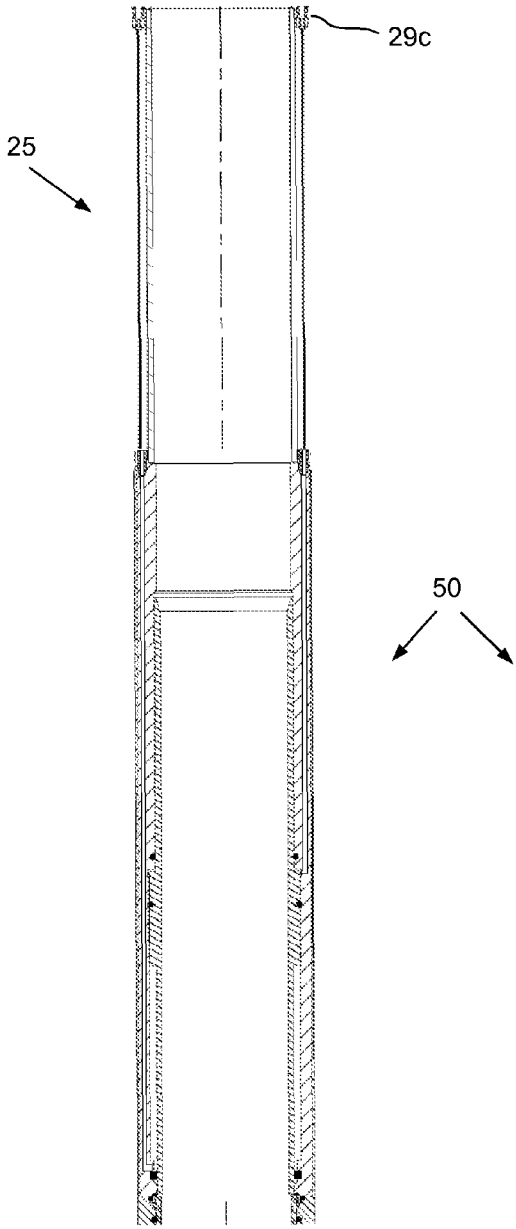
Figure 9C:
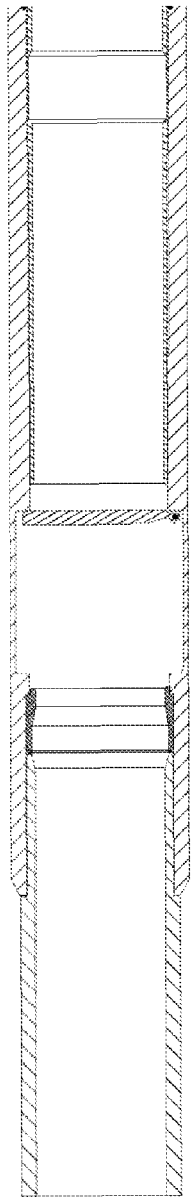

FIGS. 9A-C illustrate another isolation assembly in the closed position, according to another embodiment of the present invention. The isolation assembly may include a power sub 800, the spacer sub 25, and the isolation valve 50. The isolation assembly may be assembled as part of a casing 1015 or liner string and run-into the wellbore 1005. The casing 1015 or liner string may be cemented in the wellbore 1005 or be a tie-back casing string.

The power sub 800 may include a tubular housing 805, hydraulic pump, and an actuator 850. The housing 805 may have couplings (not shown) formed at each longitudinal end thereof for connection with other components of the casing/liner string. The couplings may be threaded, such as a box and a pin. The housing 805 may have a central longitudinal bore formed therethrough. Although shown as one piece, the housing 805 may include two or more sections to facilitate manufacturing and assembly, each section connected together, such as fastened with threaded connections. The housing 805 may have a piston chamber 805*c*, an accumulator chamber 820*a*, and a reservoir chamber 820*r* formed therein and one or more ports 805*p* providing fluid communication between the housing bore and the piston chamber 805*c*. Hydraulic fluid may be disposed in the chambers 805*c*, 820*a,r*. The housing may further have hydraulic passages 809*u,l* formed there through providing fluid communication between the actuator and respective hydraulic couplings 809*c*. The hydraulic couplings 809*c* may be connected to respective hydraulic couplings of the spacer sub 29*c*. The passage 809*u* may provide fluid communication between the actuator 850 and an upper portion of the valve chamber 57 and the passage 809*l* may provide fluid communication between the actuator and a lower portion of the valve chamber (via the spacer sub 25 and respective passages 59*p*).

The hydraulic pump may include the piston chamber 805*c*, piston 810, and check valves 815*a,r*, and a biasing member, such as a coil spring 830. Alternatively, the hydraulic pump may include a diaphragm instead of the piston 810. The piston 810 may be disposed in the piston chamber 805*c* and carry a seal on inner and outer surfaces thereof for engaging the piston chamber wall. The piston 810 may divide the piston chamber 805*c* into upper and lower portions. The spring 830 may be disposed in the piston chamber lower portion and may bias the piston toward the ports 805*p*. The hydraulic fluid may be disposed in the lower portion of the piston chamber 805*c*.

The upper piston chamber portion may be in fluid communication with the housing bore via the ports 805*p* and the lower portion may be in communication with the check valve 815*a* via a hydraulic passage 808*a* formed longitudinally through a wall of the housing 805. The passage 808*a* may also provide fluid communication between the check valve 815*a* and the accumulator chamber 820*a* and between the accumulator chamber and the actuator 850. The check valve 815*a* may be operable to allow hydraulic fluid flow therethrough from the piston chamber lower portion to the accumulator chamber 820*a* and prevent reverse flow therethrough. The lower piston chamber portion may also be in communication with a check valve 815*r* via a hydraulic passage 808*r* formed longitudinally through a wall of the housing 805. The passage 808*r* may also provide fluid communication between the check valve 815*r* and the reservoir chamber 820*r* and between the reservoir chamber and the actuator 850. The check valve 815*r* may be operable to allow hydraulic fluid flow therethrough from the reservoir chamber 820*r* to the piston chamber lower portion and prevent reverse flow therethrough.

Each of the accumulator 820*a* and reservoir 802*r* chambers may include a divider, such as a floating piston, bellows, or diaphragm, dividing each chamber into a gas portion and a hydraulic portion. A gas, such as nitrogen, may be disposed in the gas portion and hydraulic fluid may be disposed in the hydraulic portion.

In operation, the hydraulic pump may utilize fluctuations in the housing (casing) bore to pressurize the accumulator chamber 820*a*. For example, as drilling fluid 1045*f* is circulated for drilling the wellbore 1005, friction due to the returns 1045*r* flowing up the annulus 1025 and/or use of the choke 1065 may substantially increase the pressure in the bore as compared to hydrostatic pressure. Pressure in the bore may cause longitudinal movement of the piston 810 downward against the spring 830, thereby forcing hydraulic fluid through the check valve 815*a* into the accumulator 820*a*. Once pressure in the bore is reduced, the spring 830 may reset the piston 810. As the piston 810 travels longitudinally upwardly in the bore, the piston may draw hydraulic fluid from the reservoir 820*r* through the check valve 815*r*. The accumulator chamber 820*a* may store the fluid energy until it is time to open or close the valve 50. The accumulator 820*a* may store sufficient fluid energy for one or more strokes of the valve 50.

Figure 9D:
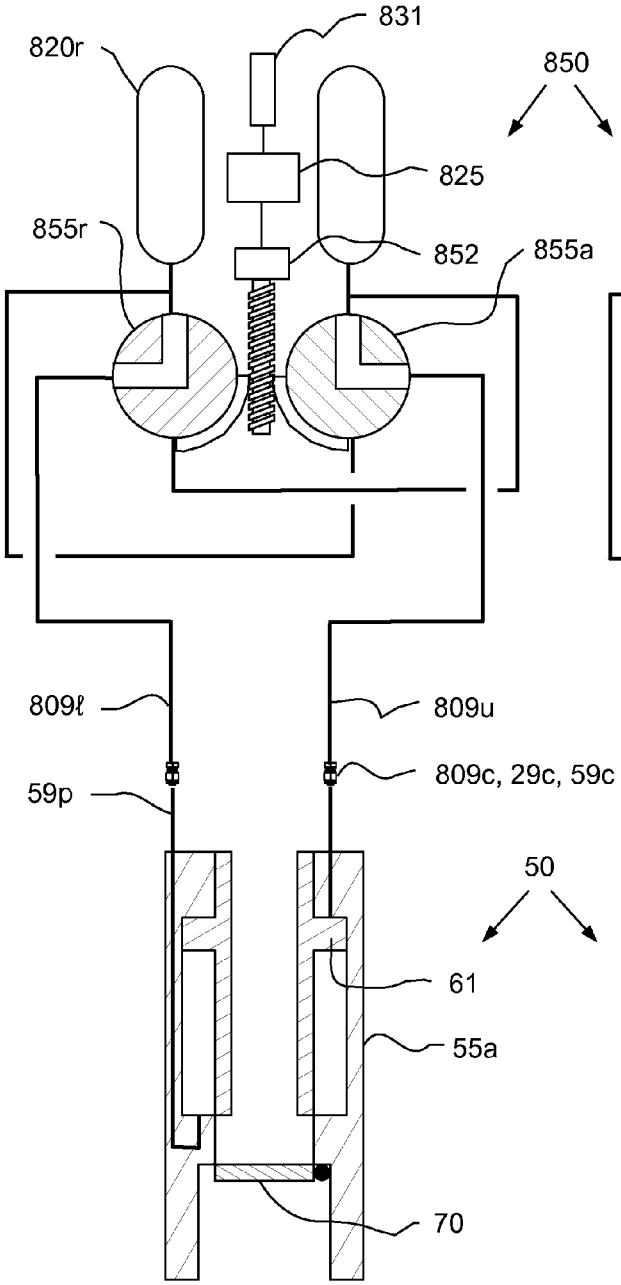
FIGS. 9D and 9E illustrate operation of an actuator of the isolation assembly.
Figure 9E:
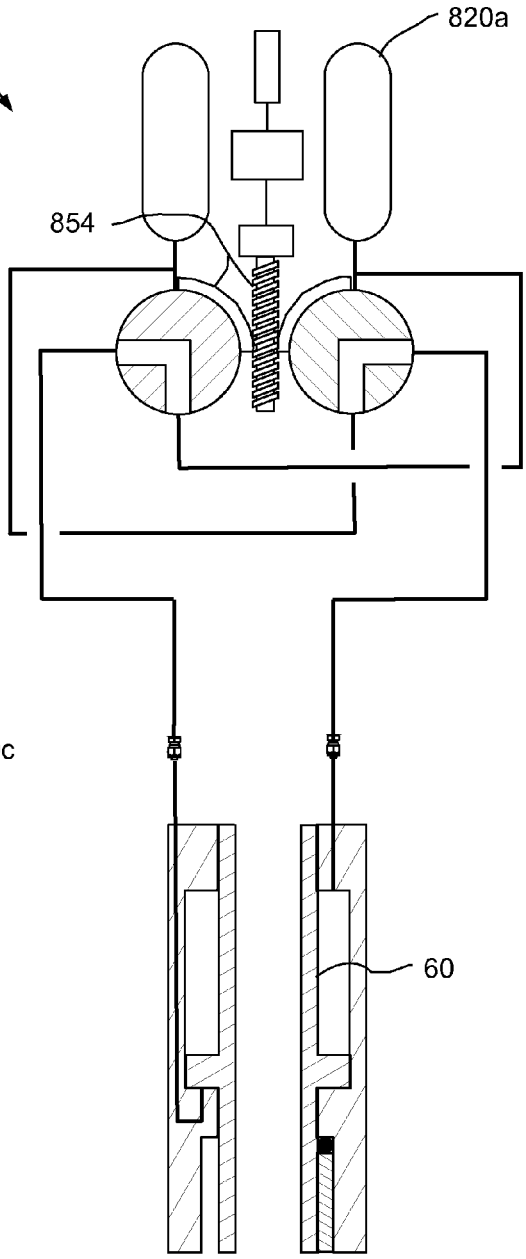

FIGS. 9D and 9E illustrate operation of the actuator 850. The actuator 850 may include an antenna 826 (FIG. 8A), an electronics package 825, a battery 831, an electric motor 852, a gearbox 854, and one or more three-way valves 855*a,r*. The antenna 826 and electronics package 825 may be similar to the antenna 226*i* and the electronics package 225, respectively. Each of the three-way valves 855*a,r* may be in fluid communication with the passages 808*a,r*, the accumulator chamber 820*a*, and the reservoir chamber 820*r* via hydraulic passages formed in a wall of the housing 805. The gear box 854 may include a drive gear rotationally connected to the motor 852 and a valve gear engaged with the drive gear and connected to each of the three-way valves 855*a,r*. The gearbox 854 may convert rotation of the motor 852 about a first axis into rotation of each of the valves about a second axis.

In operation, to open the isolation valve 50, an RFID instruction tag, such as the passive tag 250*p* may be pumped through the drill string 1050 and exit the drill string via the drill bit 1050*b*. The tag 250*p* may then be carried up the annulus 1025 until the tag 250*p* is in range of the antenna. The microprocessor may read the command encoded in the tag 250*p*, such as to open the valve 50. The microprocessor may supply electricity to the motor 852 at a first polarity. The motor 852 may rotate the valves 855*a,r* (via the gearbox) from the position in FIG. 9E to the position in FIG. 9D. The motor 852 may include a rotor position sensor in communication with the microprocessor to indicate when the motor has fully rotated the valves 855*a,r*. The microprocessor may then shutoff electricity to the motor when the valves have reached the position illustrated in FIG. 9D. The accumulator chamber 820*a* may then supply pressurized hydraulic fluid to the piston shoulder 61 via passage 809*u*, thereby moving the flow tube 60 downward into engagement with the flapper 70. Return fluid may flow from the valve chamber 57 to the accumulator 820*a* via passage 809*l*. Once the isolation valve 50 is open, the three way valves 855*a,r* may be left in the position of FIG. 9D until the microprocessor receives a close command.

In operation, to close the isolation valve 50, an RFID instruction tag, such as the passive tag 250*p* may be pumped through the drill string 1050 and exit the drill string via the drill bit 1050*b*. The tag 250*p* may then be carried up the annulus 1025 until the tag is in range of the antenna 826. The microprocessor may read the command encoded in the tag 250*p*, such as to close the valve. The microprocessor may supply electricity to the motor 852 at a second polarity opposite to the first polarity. The motor 852 may rotate the valves (via the gearbox) from the position in FIG. 9D to the position in FIG. 9E. The microprocessor may then shutoff electricity to the motor 852 when the valves 855*a,r* have reached the position illustrated in FIG. 9E. The accumulator chamber 820*a* may then supply pressurized hydraulic fluid to the piston shoulder 61 via passage 809*l*, thereby moving the flow tube 60 upward out of engagement with the flapper 70. Return fluid may flow from the valve chamber 57 to the accumulator via passage 809*u*. Once the isolation valve 50 is open, the three way valves 855*a,r* may be left in the position of FIG. 9E until the microprocessor receives an open command.

Additionally, the actuator may include a flow meter (not shown) disposed in one or both of the passages 809*u,l* and in electrical communication with the microprocessor to serve as a position indicator. The verification RFID tag, such as the WISP tag 250*w*, may then be pumped through the drill string 1050 and return up the annulus 1025 after the valve 50 has been closed or opened to verify the position of the valve. Alternatively, the embedded tags 601*o,c* may be used to send the open and/or closed commands. Additionally, any of the chargers 605, 650, 575 may be used to charge the battery 831 and a capacitor may be used instead of or in addition to the battery as discussed above. Alternatively, the spacer sub 25 may be omitted and the power sub 800 may be incorporated into the isolation valve 50.

Figures 10A, 10B:
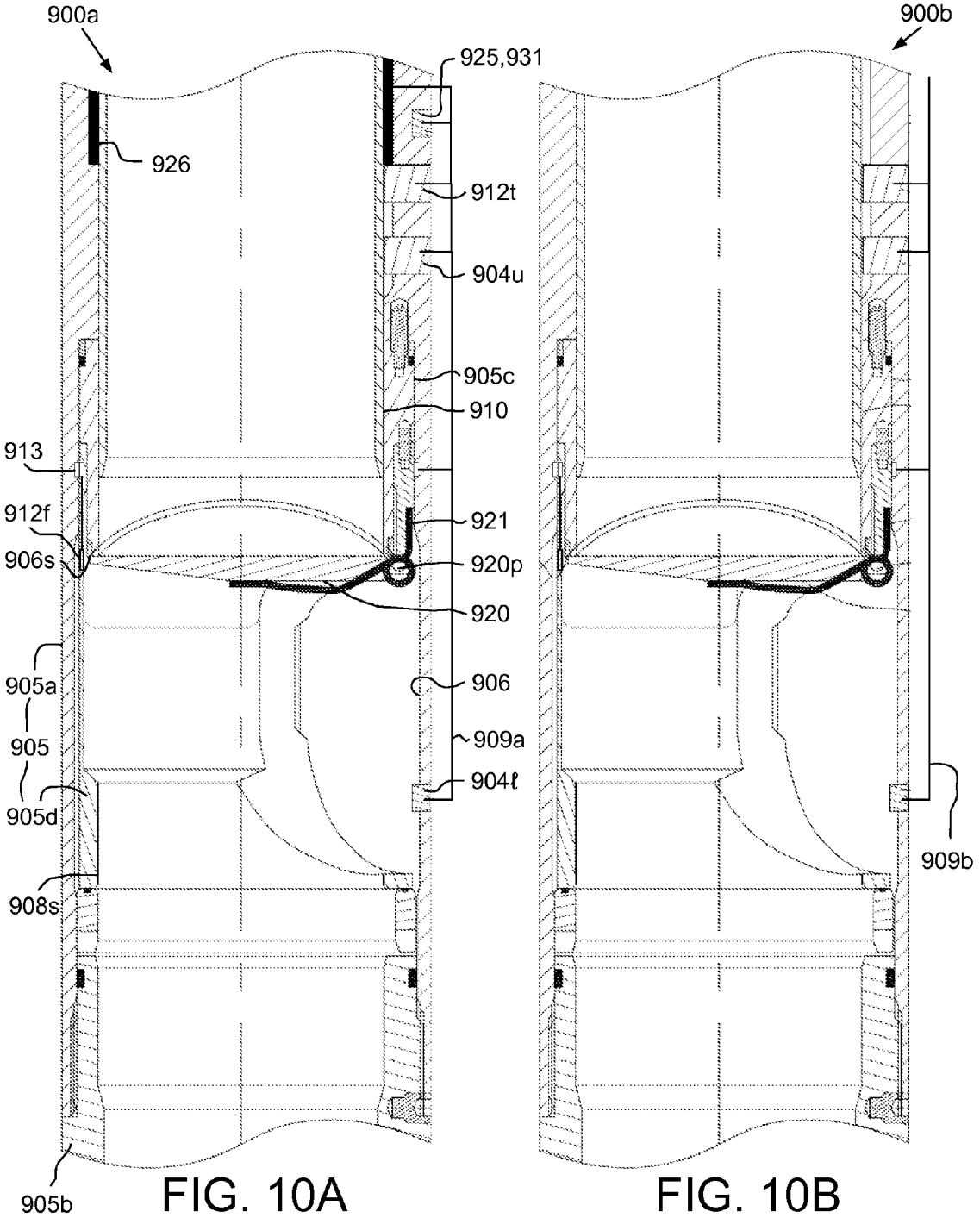
FIGS. 10A and 10B illustrate a portion of another isolation valve in the open and closed positions, respectively, according to another embodiment of the present invention.

FIG. 10A illustrates a portion of another isolation valve 900*a* in the closed position, respectively, according to another embodiment of the present invention. The isolation valve 900*a* may be used in the isolation assembly of FIGS. 1A-C to replace a lower portion (FIG. 1C) of the isolation valve 50.

The isolation valve 900*a* may include a tubular housing 905*a*, a flow tube 910, and a closure member, such as the flapper 920. As discussed above, the closure member may be a ball (not shown) instead of the flapper 920. To facilitate manufacturing and assembly, the housing 905 may include one or more sections 905*a-d* each connected together, such as fastened with threaded connections and/or fasteners. The housing 905 may further include a lower adapter (not shown) connected to the section 905*b* for connection with casing or liner. The housing 905 may have a longitudinal bore formed therethrough for passage of a drill string. The flow tube 910 may be disposed within the housing 905. The flow tube 910 may be longitudinally movable relative to the housing 905.

The flow tube 910 may be longitudinally movable by the piston between the open position and the closed position. In the closed position, the flow tube 910 may be clear from the flapper 920, thereby allowing the flapper 920 to close. In the open position, the flow tube 910 may engage the flapper 920, push the flapper 920 to the open position, and engage a seat 906*s* formed in and/or fastened to a bottom of the housing section 905*c*. Engagement of the flow tube 910 with the seat 906*s* may form a chamber 906 between the flow tube 910 and the housing 905, thereby protecting the flapper 920 and the flapper seat 906*s*. The flapper 920 may be pivoted to the housing 905, such as by a fastener 920*p*. A biasing member, such as a torsion spring 921, may engage the flapper 920 and the housing 905 and be disposed about the fastener 920*p* to bias the flapper 920 toward the closed position. In the closed position, the flapper 920 may fluidly isolate an upper portion of the valve from a lower portion of the valve.

The valve 900*a* may further include one or more sensors, such as an upper pressure sensor 904*u*, a lower pressure sensor 904*f*, a flow tube position sensor 912*t*, and a flapper proximity sensor 904*f*. The valve 900*a* may further include an electronics package 925, an antenna 926, and a battery 931. The antenna 926 and electronics package 925 may be similar to the antenna 226*i* and the electronics package 225, respectively. The flow tube 910 may be made from a non-magnetic metal or alloy, such as stainless steel so as to not obstruct antenna reception. The upper pressure sensor 904*u* may be in fluid communication with the housing bore above the flapper 920 and the lower pressure sensor 904E may be in fluid communication with the housing bore below the flapper. The flow tube 910 may allow leakage thereby so as to not fluidly isolate the pressure sensors 904*u,l*. The pressure sensors 904*u,l* may also be operable to measure temperature. Lead wires 909*a* may provide electrical communication between the microprocessor and the sensors 904*u,l*, 912*f,t*. The position sensor 912*t* and proximity sensor 912*f* may each be a Hall sensor and magnet or the position sensor may be a linear voltage differential transformer (LVDT). Alternatively, the proximity sensor 912*f* may be a contact switch. The flow tube position sensor 912*t* may be able to detect when the flow tube 910 is in the open position, the closed position, or at any position between the open and closed positions so that the microprocessor may detect full or partial opening of the valve. The flapper proximity sensor 912*f* may detect closure of the flapper. The flapper sensor 912*f* may be in electrical communication with the leads 909*a* via contacts 913.

In operation, instead of using the position indicator 15*l* to verify opening or closing of the valve, a verification tag, such as the WISP tag 250*w* may be pumped through the drill string and return up the annulus. The valve microprocessor may read the position inquiry command encoded in the WISP tag 250*w* and report the position of the valve 50 using the position sensors 912*t,f*. The WISP tag 250*w* may record the response and continue up to the telemetry sub 200. The telemetry microprocessor may read the position from the tag 250*w* and report to the rig 1000. The WISP tag may also inquire about pressure and temperature above and/or below the flapper, record the pressure and temperature, and report the pressure and temperature to the telemetry microprocessor.

Alternatively, instead of pumping the WISP tag 250*w*, the drill string may include one or more embedded WISP tags 250*w* similar to the tag 601*c*. The tag may then be read when the drill string 1050 is retrieved to the rig 1000. Alternatively, the antenna 926 may be located in the power sub 1 and the leads 909*a* may extend from the valve 900*a* to the power sub so that the antenna 926 may be used to communicate with the telemetry sub.

FIG. 10B illustrates a portion of another isolation valve 900*b* in the closed position, respectively, according to another embodiment of the present invention. The isolation valve 900*b* may replace a lower portion (FIG. 6B) of any of the isolation valves 500, 500*a*, 500*b*. The isolation valve 900*b* may also be used in the isolation assembly of FIG. 8A-C or 9A-C to replace a lower portion (FIG. 8C or 9C) of the isolation valve 50. The isolation valve 900*b* may be similar to the isolation valve 900*a* except that the antenna, electronics package, and battery may be omitted in favor of extending the leads 909*b* to the existing electronics packages 525, 725, 825 of the respective valves or power subs. In this manner, the position and pressures may be reported as discussed above. Alternatively, the pressure sensor 904*u* may be used to receive pressure pulses sent from the drilling rig to carry the instruction signals instead of the RFID tag. Additionally, the pressure signals and the RFID tag may be used to send the signals and the valve 909*b* may not execute the command until receiving both signals.

Alternatively, the isolation valve 400 may replace a lower portion (FIG. 6B) of any of the isolation valves 500, 500*a*, 500*b*. The isolation valve 900*b* may also be used in the isolation assembly of FIG. 8A-C or 9A-C to replace a lower portion (FIG. 8C or 9C) of the isolation valve 50.

Figure 11A:
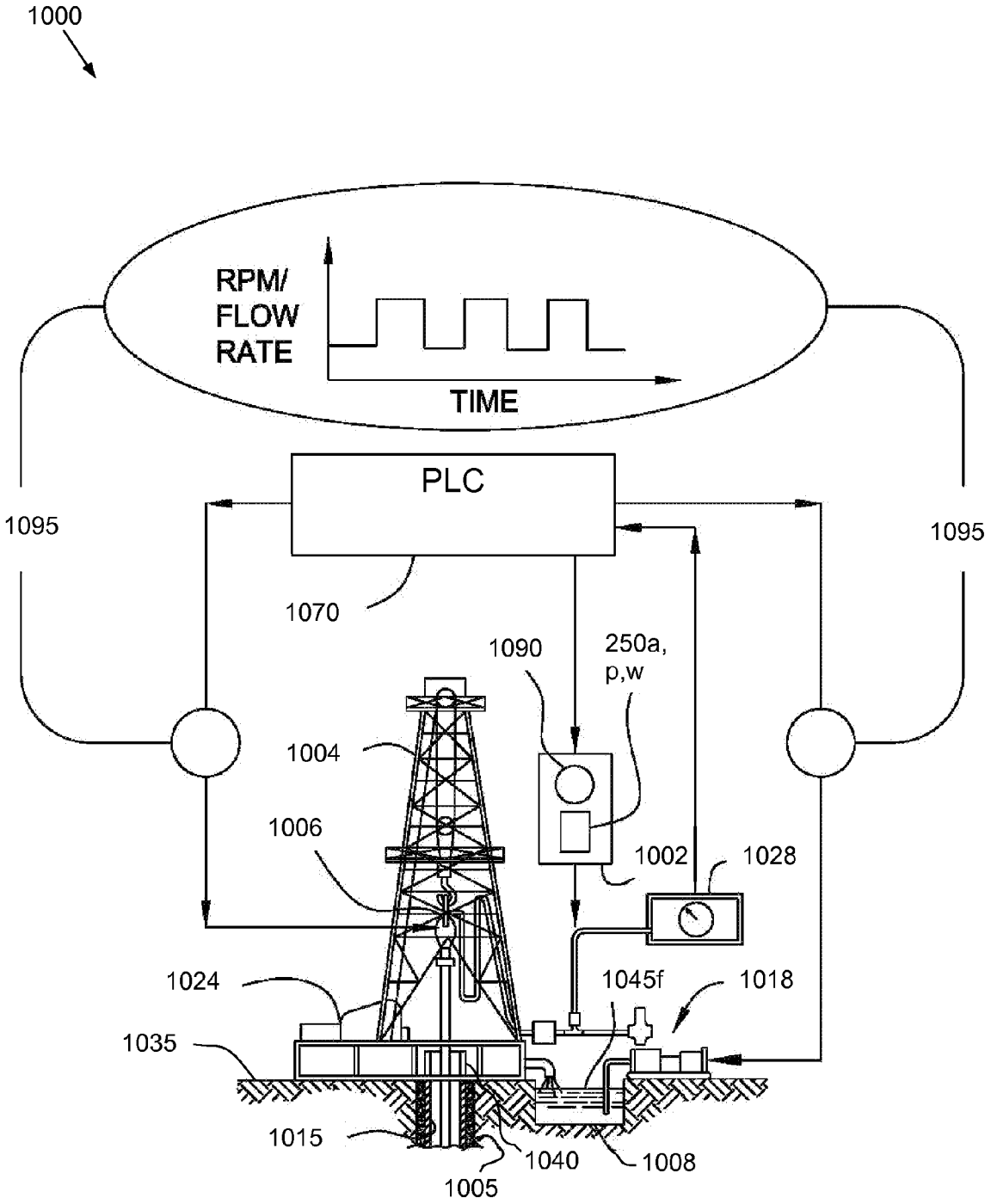
FIG. 11A illustrates a drilling rig for drilling a wellbore, according to another embodiment of the present invention.
Figures 11B, 11C:
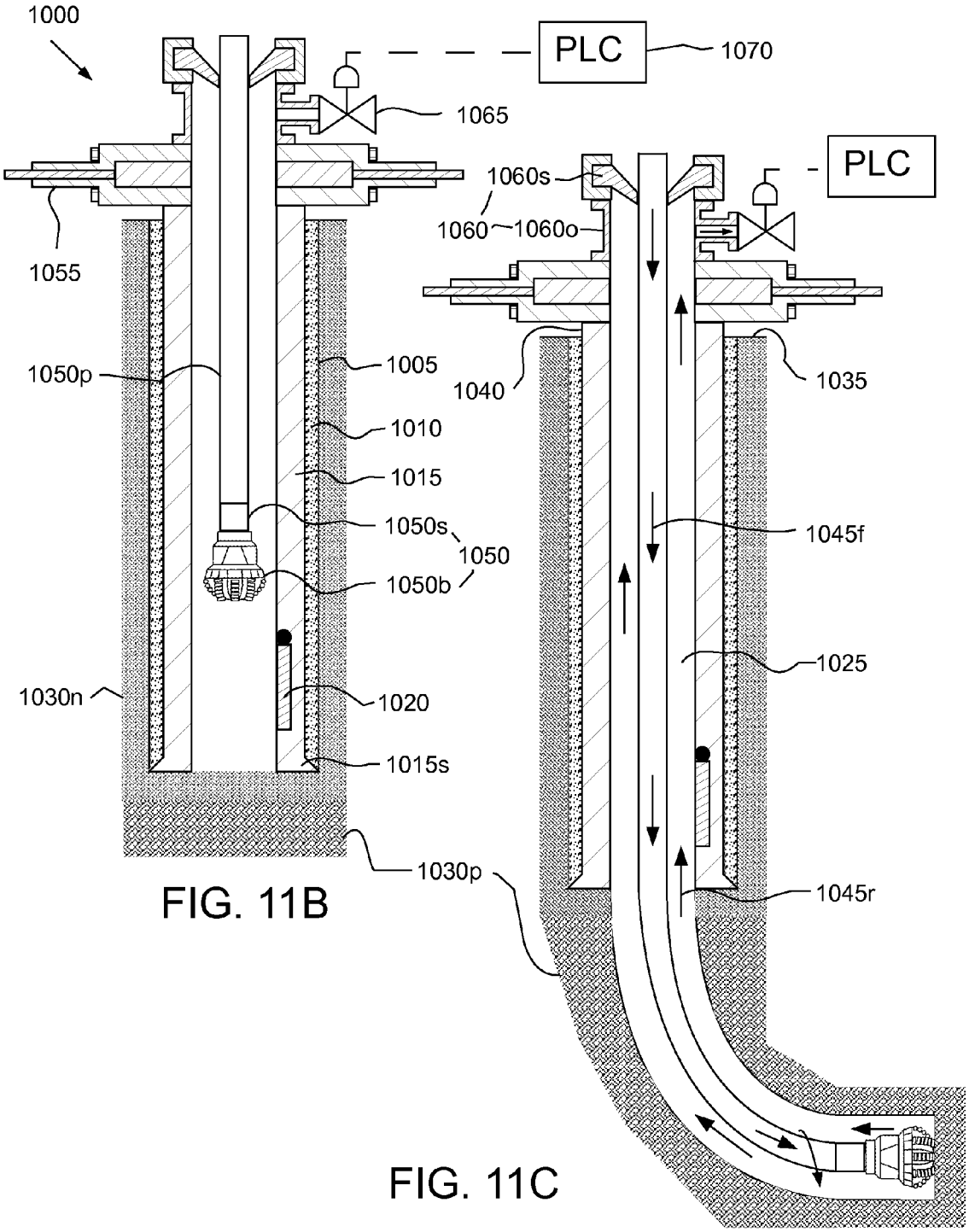
FIGS. 11B-11I illustrate a method of drilling and completing a wellbore using the drilling rig.
Figure 11E:
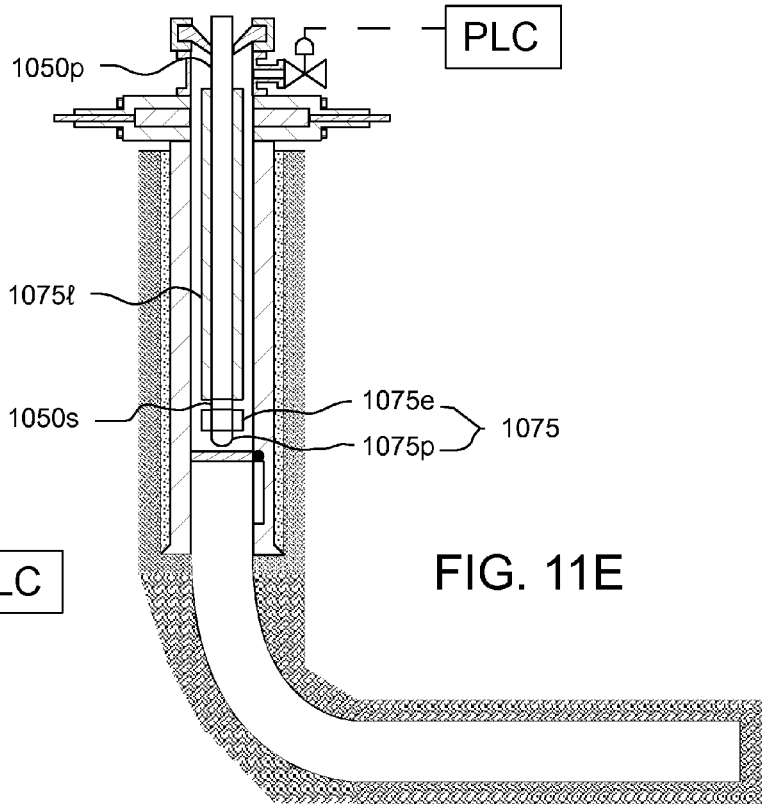
Figure 11D:
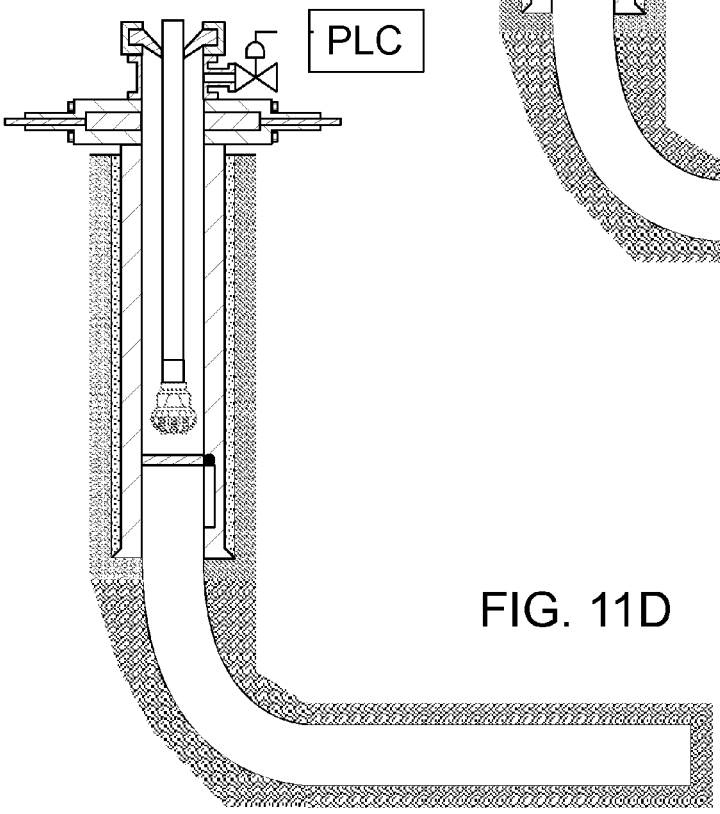
Figure 11G:
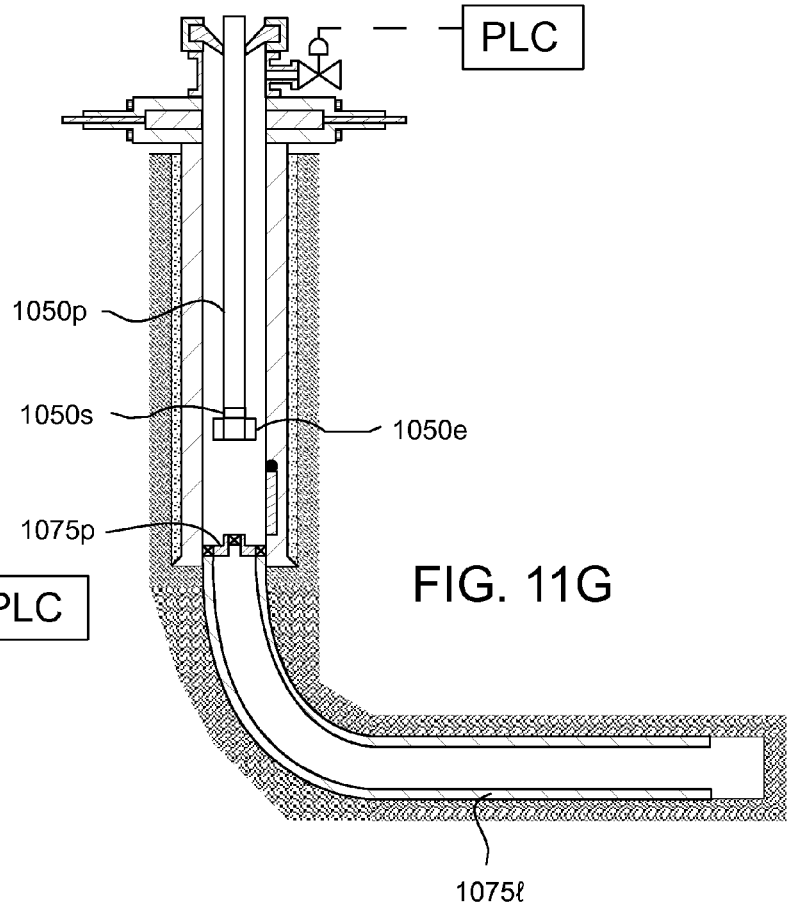
Figure 11F:
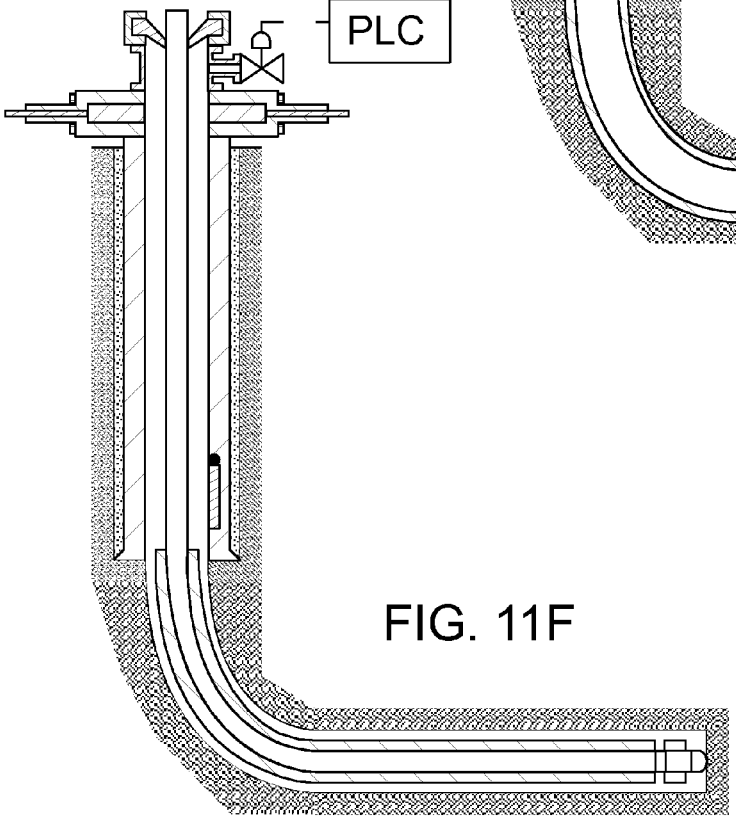
Figures 11H, 11I:
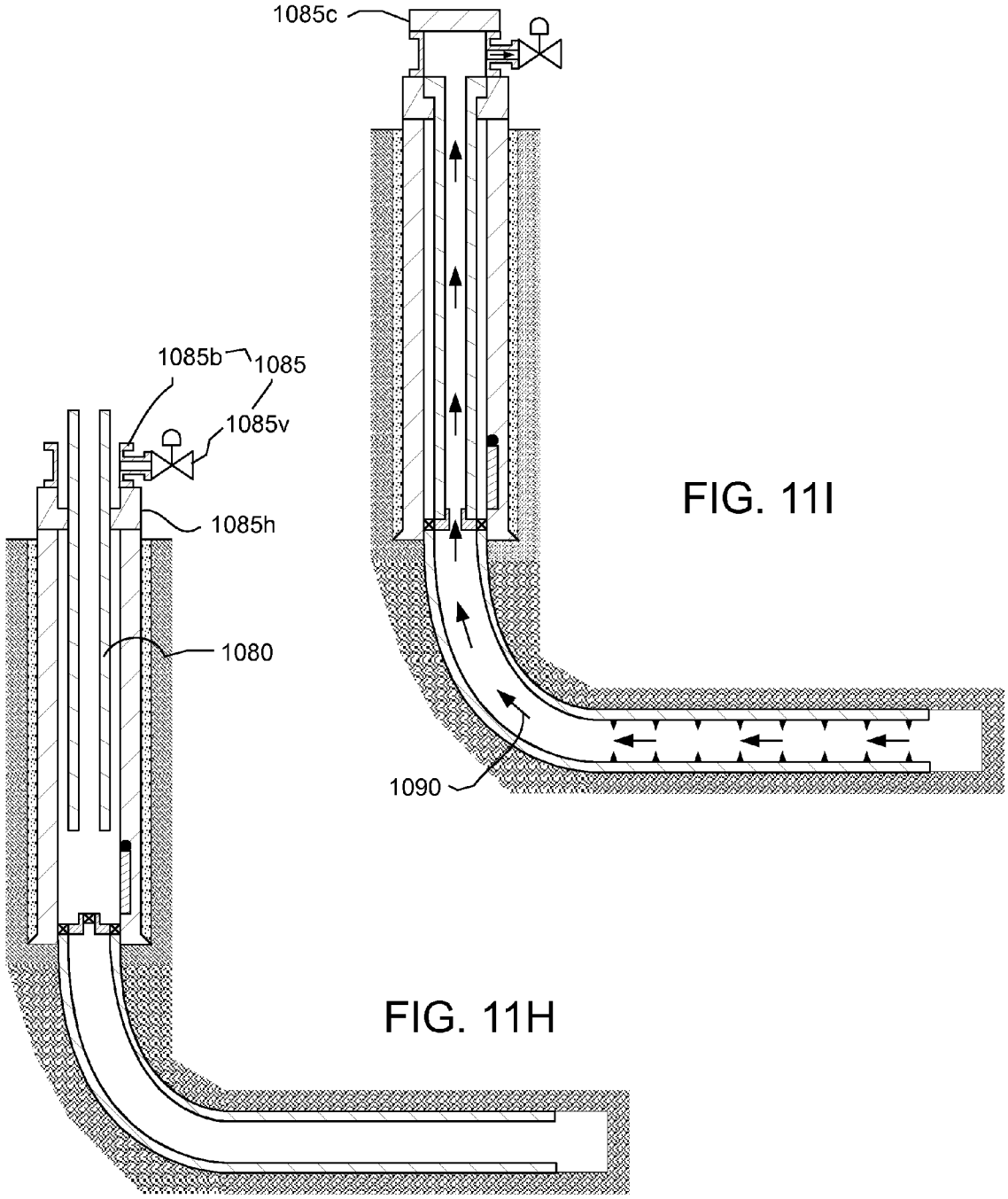

FIG. 11A illustrates a drilling rig 1000 for drilling a wellbore 1005, according to another embodiment of the present invention. The drilling rig 1000 may be deployed on land or offshore. If the wellbore 1005 is subsea, then the drilling rig 1000 may be a mobile offshore drilling unit, such as a drillship or semisubmersible. The drilling rig 1000 may include a derrick 1004. The drilling rig 1000 may further include drawworks 1024 for supporting a top drive 1006. The top drive 1006 may in turn support and rotate a drill string 1050. Alternatively, a Kelly and rotary table (not shown) may be used to rotate the drill string instead of the top drive. The drilling rig 1000 may further include a rig pump 1018 operable to pump drilling fluid 1045*f* from of a pit or tank 1008, through a standpipe and Kelly hose to the top drive 1006. The drilling fluid 1045*f* may include a base liquid. The base liquid may be refined oil, water, brine, or a water/oil emulsion. The drilling fluid 1045*f* may further include solids dissolved or suspended in the base liquid, such as organophilic clay, lignite, and/or asphalt, thereby forming a mud. The drilling fluid 1045*f* may further include a gas, such as diatomic nitrogen mixed with the base liquid, thereby forming a two-phase mixture. If the drilling fluid is two-phase, the drilling rig 1000 may further include a nitrogen production unit (not shown) operable to produce commercially pure nitrogen from air.

The drilling rig 1000 may further include a launcher 1002, programmable logic controller (PLC) 1070, and a pressure sensor 1028. The pressure sensor 1028 may detect mud pulses sent from the telemetry sub 200. The PLC 1070 may be in data communication with the rig pump 1018, launcher 1002, pressure sensor 1028, and top drive 1006. The rig pump 1018 and/or top drive 1006 may include a variable speed drive so that the PLC 1070 may modulate 1095 a flow rate of the rig pump 1018 and/or an angular speed (RPM) of the top drive 1006. The modulation 1045 may be a square wave, trapezoidal wave, or sinusoidal wave. Alternatively, the PLC 1070 may modulate the rig pump and/or top drive by simply switching them on and off.

FIGS. 11B-11I illustrate a method of drilling and completing a wellbore using the drilling rig 1000. An upper section of a wellbore 1005 through a non-productive formation 1030*n* has been drilled using the drilling rig 1000. A casing string 1015 has been installed in the wellbore 1005 and cemented 1010 in place. One of the isolation valve/assemblies discussed and illustrated above has been assembled as part of the casing string 1015 and is represented by the depiction of a flapper 1020. Alternatively, as discussed above, the isolation valve/assembly may instead be assembled as part of a tie-back casing string received by a polished bore receptacle of a liner string cemented to the wellbore. The isolation valve 1020 may be in the open position for deployment and cementing of the casing string. Once the casing string 1015 has been deployed and cemented, a drill string 1050 may be deployed into the wellbore for drilling of a productive hydrocarbon bearing (i.e., crude oil and/or natural gas) formation 1030*p*.

The drilling fluid 1045*f* may flow from the standpipe and into the drill string 1050 via a swivel (Kelly or top drive, not shown). The drilling fluid 1045*f* may be pumped down through the drill string 1050 and exit a drill bit 1050*b*, where the fluid may circulate the cuttings away from the bit 1050*b* and return the cuttings up an annulus 1025 formed between an inner surface of the casing 1015 or wellbore 1005 and an outer surface of the drill string 1050. The return mixture (returns) 1045*r* may return to a surface 1035 of the earth and be diverted through an outlet 1060*o* of a rotating control device (RCD) 1060 and into a primary returns line (not shown). The returns 1045*r* may then be processed by one or more separators (not shown). The separators may include a shale shaker to separate cuttings from the returns and one or more fluid separators to separate the returns into gas and liquid and the liquid into water and oil.

The RCD 1060 may provide an annular seal 1060*s* around the drill string 1050 during drilling and while adding or removing (i.e., during a tripping operation to change a worn bit) segments or stands to/from the drill string 1050. The RCD 1060 achieves fluid isolation by packing off around the drill string 1050. The RCD 1060 may include a pressure-containing housing mounted on the wellhead where one or more packer elements 1060*s* are supported between bearings and isolated by mechanical seals. The RCD 1060 may be the active type or the passive type. The active type RCD uses external hydraulic pressure to activate the packer elements 1060*s*. The sealing pressure is normally increased as the annulus pressure increases. The passive type RCD uses a mechanical seal with the sealing action supplemented by wellbore pressure. If the drillstring 1050 is coiled tubing or other non-jointed tubular, a stripper or pack-off elements (not shown) may be used instead of the RCD 1060. One or more blowout preventers (BOPs) 1055 may be attached to the wellhead 1040.

A variable choke valve 1065 may be disposed in the returns line. The choke 1065 may be in communication with a programmable logic controller (PLC) 1070 and fortified to operate in an environment where the returns 1045*r* contain substantial drill cuttings and other solids. The choke 1065 may be employed during normal drilling to exert back pressure on the annulus 1025 to control bottom hole pressure exerted by the returns on the productive formation. The drilling rig 1000 may further include a flow meter (not shown) in communication with the returns line to measure a flow rate of the returns and output the measurement to the PLC 1070. The flow meter may be single or multi-phase. Alternatively, a flow meter in communication with the PLC 1070 may be in each outlet of the separators to measure the separated phases independently.

The PLC 1070 may further be in communication with the rig pump to receive a measurement of a flow rate of the drilling fluid injected into the drill string. In this manner, the PLC may perform a mass balance between the drilling fluid 1045*f* and the returns 1045*r* to monitor for formation fluid 1090 entering the annulus 1025 or drilling fluid 1045*f* entering the formation 1030*p*. The PLC 1070 may then compare the measurements to calculated values by the PLC 1070. If nitrogen is being used as part of the drilling fluid, then the flow rate of the nitrogen may be communicated to the PLC 1070 via a flow meter in communication with the nitrogen production unit or a flow rate measured by a booster compressor in communication with the nitrogen production unit. If the values exceed threshold values, the PLC 1070 may take remedial action by adjusting the choke 1065. A first pressure sensor (not shown) may be disposed in the standpipe, a second pressure sensor (not shown) may be disposed between the RCD outlet 1060*o* and the choke 1065, and a third pressure sensor (not shown) may be disposed in the returns line downstream of the choke 1065. The pressure sensors may be in data communication with the PLC.

The drill string 1050 may include the drill bit 1050*b* disposed on a longitudinal end thereof, one of the shifting tools discussed above (depicted by 1050*s*), and a string of drill pipe 1050*p*. Alternatively, casing, liner, or coiled tubing may be used instead of the drill pipe 1050*p*. The drill string 1050 may also include a bottom hole assembly (BHA) (not shown) that may include the bit 1050*b*, drill collars, a mud motor, a bent sub, measurement while drilling (MWD) sensors, logging while drilling (LWD) sensors and/or a float valve (to prevent backflow of fluid from the annulus). The mud motor may be a positive displacement type (i.e., a Moineau motor) or a turbomachine type (i.e., a mud turbine). The drill string 1050 may further include float valves distributed therealong, such as one in every thirty joints or ten stands, to maintain back-pressure on the returns while adding joints thereto. The drill string 1050 may also include one or more centralizers 1050*c* (FIG. 14D) spaced therealong at regular intervals. The drill bit 1050*b* may be rotated from the surface by the rotary table or top drive and/or downhole by the mud motor. If a bent sub and mud motor is included in the BHA, slide drilling may be effected by only the mud motor rotating the drill bit and rotary or straight drilling may be effected by rotating the drill string from the surface slowly while the mud motor rotates the drill bit. Alternatively, if coiled tubing is used instead of drill pipe, the BHA may include an orienter to switch between rotary and slide drilling. If the drill string 1050 is casing or liner, the liner or casing may be suspended in the wellbore 1005 and cemented after drilling.

The drill string 1050 may be operated to drill through the casing shoe 1015*s* and then to extend the wellbore 1005 by drilling into the productive formation 1030*p*. A density of the drilling fluid 1045*f* may be less than or substantially less than a pore pressure gradient of the productive formation 1030*p*. A free flowing (non-choked) equivalent circulation density (ECD) of the returns 1045*r* may also be less than or substantially less than the pore pressure gradient. During drilling, the variable choke 1065 may be controlled by the PLC 1070 to maintain the ECD to be equal to (managed pressure) or less than (underbalanced) the pore pressure gradient of the productive formation 1030*p*. If, during drilling of the productive formation, the drill bit 1050*b* needs to be replaced or after total depth is reached, the drill string 1050 may be removed from the wellbore 1005. The drill string 1050 may be raised until the drill bit 1050*b* is above the flapper 1020 and the shifting tool 1050*s* is aligned with the power sub. The shifting tool 1050*s* may then be operated to engage the power sub (or one of the power subs) to close the flapper 1020. Alternatively, as discussed above, the shifting tool 1050*s* may be omitted for some of the embodiments (i.e., the valve 500) and an instruction signal may be sent to the valve 1020.

The drill string 1050 may then be further raised until the BHA/drill bit 1050*b* is proximate the wellhead 1040. An upper portion of the wellbore 1005 (above the flapper 1020) may then be vented to atmospheric pressure. The returns 1045*r* may also be displaced from the upper portion of the wellbore using air or nitrogen. The RCD 1060 may then be opened or removed so that the drill bit/BHA 1050*b* may be removed from the wellbore 1005. If total depth has not been reached, the drill bit 1050*b* may be replaced and the drill string 1050 may be reinstalled in the wellbore. The annulus 1025 may be filled with drilling fluid 1045*f*, pressure in the upper portion of the wellbore 1005 may be equalized with pressure in the lower portion of the wellbore 1005. The shifting tool 1050*s* may be operated to engage the power sub and open the flapper 1020. Drilling may then resume. In this manner, the productive formation 1030*p* may remain live during tripping due to isolation from the upper portion of the wellbore by the closed flapper 1020, thereby obviating the need to kill the productive formation 1030*p*.

Once drilling has reached total depth, the drill string 1050 may be retrieved to the drilling rig as discussed above. A liner string, such as an expandable liner string 1075*f*, may then be deployed into the wellbore 1005 using a workstring 1075. The workstring 1075 may include an expander 1075*e*, the shifting tool 1050*s*, a packer 1075*p* and the string of drill pipe 1050*p*. The expandable liner 1075*l* may be constructed from one or more layers, such as three. The three layers may include a slotted structural base pipe, a layer of filter media, and an outer shroud. Both the base pipe and the outer shroud may be configured to permit hydrocarbons to flow through perforations formed therein. The filter material may be held between the base pipe and the outer shroud and may serve to filter sand and other particulates from entering the liner 1075*l*. The liner string 1075*l* and workstring 1050*s* may be deployed into the live wellbore using the isolation valve 1020, as discussed above for the drill string 1050.

Once deployed, the expander 1075*e* may be operated to expand the liner 1075*l* into engagement with a lower portion of the wellbore traversing the productive formation 1030*p*. Once the liner 1075*l* has been expanded, the packer 1070*s* may be set against the casing 1015. The packer 1075*p* may include a removable plug set in a housing thereof, thereby isolating the productive formation 1030*p* from the upper portion of the wellbore 1005. The packer housing may have a shoulder for receiving a production tubing string 1080. Once the packer is set, the expander 1075*e*, the shifting tool 1050*s*, and the drill pipe 1050*p* may be retrieved from the wellbore using the isolation valve 1020 as discussed above for the drill string 1050.

Alternatively, a conventional solid liner may be deployed and cemented to the productive formation 1030*p* and then perforated to provide fluid communication. Alternatively, a perforated liner (and/or sandscreen) and gravel pack may be installed or the productive formation 1030*p* may be left exposed (a.k.a. barefoot).

The RCD 1060 and BOP 1055 may be removed from the wellhead 1040. A production (aka Christmas) tree 1085 may then be installed on the wellhead 1040. The production tree 1085 may include a body 1085*b*, a tubing hanger 1085*h*, a production choke 1085*v*, and a cap 1085*c* and/or plug. Alternatively, the production tree 1085 may be installed after the production tubing 1080 is hung from the wellhead 1040. The production tubing 1080 may then be deployed and may seat in the packer body. The packer plug may then be removed, such as by using a wireline or slickline and a lubricator. The tree cap 1085*c* and/or plug may then be installed. Hydrocarbons 1090 produced from the formation 1030*p* may enter a bore of the liner 1075*l*, travel through the liner bore, and enter a bore of the production tubing 1080 for transport to the surface 1035.

Figures 12A, 12B:
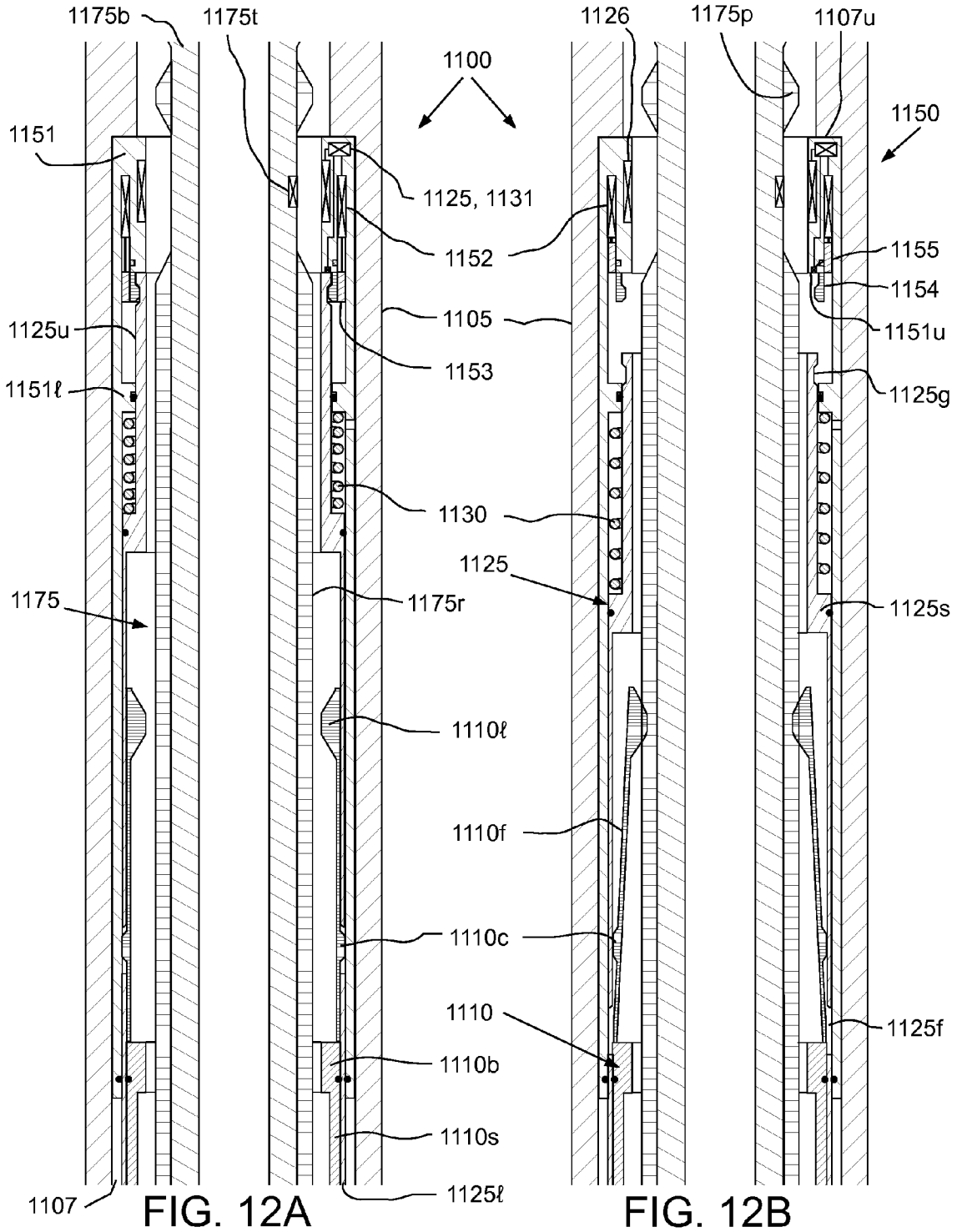
FIG. 12A illustrates a portion of a power sub for use with the isolation assembly in a retracted position, according to another embodiment of the present invention.
FIG. 12B illustrates a portion of the power sub in an extended position.

FIG. 12A illustrates a portion of a power sub 1100 for use with the isolation assembly in a retracted position, according to another embodiment of the present invention. FIG. 12B illustrates a portion of the power sub 1100 in an extended position.

The power sub 1100 may include a tubular housing 1105, a tubular mandrel 1110, a sleeve 1125, an actuator 1150, a piston (not shown, see 315), and a driver (not shown). The housing 1105 may have couplings (not shown) formed at each longitudinal end thereof for connection with other components of the casing/liner string. The couplings may be threaded, such as a box and a pin. The housing 1105 may have a central longitudinal bore formed therethrough. Although shown as one piece, the housing 1105 may include two or more sections to facilitate manufacturing and assembly, each section connected together, such as fastened with threaded connections. The power sub 1100 may be operated by a shifting tool 1175 assembled as part of the drill string 1050 instead of the shifting tool 1050*s*.

The mandrel 1110 may be disposed within the housing 1105, longitudinally connected thereto, and rotatable relative thereto. The mandrel 1110 may include an upper drive portion 1110*c,f,l*, and a lower sleeve portion 1110*s* connected by a base portion 1110*b*. The drive portion may include a plurality of split collet fingers 1110*f* extending longitudinally from the (solid) base 1110*b*. The fingers 1110*f* may have lugs 1110*l* formed at an end distal from the base 1110*b*. The fingers 1110*f* may be operated between the retracted position and the extended position by interaction with the sleeve 1125. The sleeve 1125 may include an upper sleeve portion 1125*u* and a lower sleeve portion 1125*l* connected by a shoulder portion 1125*s*. The fingers 1110*f* may further include cams 1110*c* formed in an outer surface thereof. Each cam 1110*c* may be received by a follower, such as a slot 1125*f*, when the fingers are in the retracted position. Each slot 1125*f* may be formed through a wall of the lower sleeve portion 1125*l* and a periphery thereof may have an inclined surface for mating with a corresponding inclined surface of the cam 1110*c* during movement of the fingers 1110*f* from the retracted position to the extended position. The fingers 1110*f* may be naturally biased toward the retracted position.

The lugs 1110*l* may mate with a torque profile when the power sub 1100 is in the extended position. The torque profile may include a plurality of ribs 1175*r*, spaced around and extending along an outer surface of a body 1175*b* of the shifting tool 1175, thereby rotationally connecting the shifting tool and the mandrel 1110 while allowing relative longitudinal movement therebetween. The ribs 1175*r* may have a length substantially greater than a length of the lugs 1110*l* to provide an engagement tolerance and/or to compensate for heave of the drill string 1050 for subsea drilling operations. The mandrel 1110 may further have a helical profile (not shown) formed in an outer surface of the sleeve portion 1110*s*.

The actuator 1150 may include an antenna 1126, an electronics package 1125, a battery 1131, a case 1151, a lock 1152, 1153, a latch 1154, a proximity sensor 1155 (or position sensor, see 755) and a biasing member, such as a coil spring 1130. The antenna 1126 and electronics package 1125 may be similar to the antenna 226*i* and the electronics package 225, respectively. The housing 1105 may further have upper 1107*u* and lower (not shown) shoulders formed in an inner surface thereof. The chamber 1107 may be defined longitudinally between an upper seal disposed between the housing 1105 and the case 1151 proximate the upper shoulder 1107*u* and lower seals disposed between the housing 1105 and the driver and between the mandrel 1110 and the driver proximate the lower shoulder. Lubricant may be disposed in an isolated portion of the chamber 1107. A compensator piston (not shown) may be disposed in the housing 1105 to compensate for displacement of lubricant due to movement of the driver and/or sleeve 1125. The compensator piston may also serve to equalize pressure of the lubricant (or slightly increase) with pressure in the housing bore.

The case 1151 may be tubular and have upper 1151*u* and lower 1151*l* shoulders formed in an inner surface thereof. The case 1151 may be longitudinally connected to the housing 1105. The spring 1130 may be disposed in a sub-chamber against a bottom of the lower shoulder 1151*l* and a top of the shoulder 1125*s*, thereby biasing the sleeve 1125 toward a lower position where the fingers 1110*f* are extended. The sleeve 1125 may be selectively restrained in an upper position (where the fingers 1110*f* are retracted) by the latch 1154 and the lock 1152, 1153. The latch may be a collet 1154 connected to the case 1151, such as being fastened. The collet 1154 may include a base ring and two or more radially split fingers. The upper sleeve portion 1125*u* may have a profile 1125*g* formed in an outer surface thereof for receiving the collet 1154, thereby longitudinally connecting the sleeve 1125 and the case 1151. The collet 1154 may be naturally biased into engagement with the profile 1125*g*. The spring bias may be sufficient to drive the collet 1154 from the profile 1125*g*.

The lock may include a linear actuator 1152, such as a linear motor, and a sleeve 1153 longitudinally movable relative to the housing by the linear actuator between a locked position and an unlocked position. The sleeve 1153 may engage an outer surface of the collet fingers in the locked position, thereby keeping the fingers from radially moving out of the profile 1125*g*. The sleeve 1153 may be clear of the fingers in the unlocked position, thereby allowing the collet fingers to radially move out of the profile 1125*g*. The linear actuator 1152 may be fastened to the case 1151 and be in electrical communication with the electronics package 1125 via internal leads. The proximity sensor 1155 may be a contact switch or Hall sensor and magnet operable to detect proximity/contact between a top of the sleeve 1125 and the shoulder 1151*u* and may be in electrical communication with the microprocessor via leads. The microprocessor may use the proximity sensor 1155 to determine when the profile 1125*g* is aligned with the collet fingers to extend the lock sleeve 1153 and lock the collet fingers in the profile. The microprocessor may also use the proximity sensor to verify that the valve has opened or closed. The antenna 1126 may be bonded or fastened to an inner surface of the case 1151 and in electromagnetic communication with the housing bore. The antenna 1126 may be in electrical communication with the microprocessor via leads.

The piston may be tubular and have a shoulder disposed in a piston chamber (not shown, see 306) formed in the housing 1105. The housing 1105 may further have upper and lower shoulders (not shown, see 306*u,l*) formed in an inner surface thereof. The piston chamber may be defined radially between the piston and the housing 1105 and longitudinally between an upper seal (not shown) disposed between the housing 1105 and the piston proximate the upper shoulder and a lower seal (not shown) disposed between the housing 1105 and the piston proximate the lower shoulder. A piston seal (not shown) may also be disposed between the piston shoulder and the housing 1105. Hydraulic fluid may be disposed in the piston chamber. Each end of the piston chamber may be in fluid communication with a respective hydraulic coupling (not shown) via a respective hydraulic passage (not shown, see 309*p*) formed longitudinally through a wall of the housing 1105.

The driver may be disposed between the mandrel 1110 and the housing 1105 and longitudinally movable relative to the housing 1105 between an upper position and a lower position. The driver may be rotationally connected to the housing 1105 and longitudinally movable relative thereto. The driver may interact with the mandrel 1110 by having a helical profile formed in an inner surface thereof mated with the mandrel helical profile. The driver may be longitudinally connected to the piston or formed integrally therewith. The helical profiles may allow the driver to longitudinally translate while not rotating while the mandrel 1110 is rotated by the shifting tool 1175 and not translated. The driver may also interact with the sleeve 1125. As the sleeve 1125 is moved from the upper position to the lower position by the spring 1130, a bottom of the sleeve may engage a top of the driver, thereby stopping movement of the sleeve at the lower position.

Two power subs 1100 (only one shown) may be hydraulically connected to the isolation valve 50 in a three-way configuration such that each of the power sub pistons are in opposite positions and operation of one of the power subs 1100 will operate the isolation valve 50 between the open and closed positions and alternate the other power sub 1100. This three way configuration may allow each power sub 1100 to be operated in only one rotational direction and each power sub 1100 to only open or close the isolation valve 50. Respective hydraulic couplings of each power sub 1100 and the isolation valve 50 may be connected by a conduit, such as tubing (not shown).

The shifting tool 1175 may include a opener or closer tag 1175*t*, similar to the opener or closer tags 601*o,c*, embedded in an outer surface of the body 1175*b*. The embedded tag 1175*c* may be located proximate to an end of the ribs 1175*r*. The shifting tool 1175 may further include a protector 1175*p* formed proximate to the tag 1175*t* on an opposite end thereof, thereby straddling the tag to prevent damage thereto. The drill string 1050 may further include a second shifting tool (not shown) similar or identical to the shifting tool 1100 except for including the other of the opener and closer tag. Alternatively, one of the tags 250*a,p,w* may be pumped through the drill string 1050 instead of using the embedded tags 1175*t* and the same shifting tool may be used to operate both power subs.

In operation, once the actuator 1150 receives the instruction signal from the tag 1175*c*, the microprocessor may operate the linear actuator 1152 to retract the lock sleeve 1153, thereby releasing the sleeve 1125. The spring 1130 may push the sleeve 1125 and extend the fingers 1110*f*, thereby engaging the lugs 1110*l* with the ribs 1125*r*. The drill string 1050 may be rotated, thereby rotating the shifting tool 1175. If the lugs 1110*l* are misaligned, the lugs may engage the ribs 1175*r* as rotation of the shifting tool 1175 begins. Rotation of the shifting tool 1175 may drive rotation of the mandrel 1110. Rotation of the mandrel 1110 may longitudinally drive the driver upward due to interaction of the helical profiles. The driver may pull the piston longitudinally to the upper position, thereby pumping hydraulic fluid to the isolation valve 50 and opening or closing the valve. As the driver moves upward, the driver may push the sleeve 1125 toward the upper shoulder 1151*u* until the sleeve profile 1125*g* engages the latch 1154 and the cams 1110*c* engage the slots 1125*f*, thereby retracting the fingers 1110*f*. Retraction of the fingers 1110*f* may ensure that continued rotation of the shifting tool 1175 does not damage the power sub 1100 and the isolation valve 50. The microprocessor may then detect engagement of the profile 1125*g* with the latch 1154 and engage the lock 1154.

Once the other power sub is operated by the respective shifting tool, fluid returning from the isolation valve 50 may push the piston downward, thereby longitudinally pulling the driver to the lower position. The mandrel 1110 may freely counter-rotate to facilitate the movement. The power sub 1100 may now be reset for further operation.

Additionally, any of the chargers 600, 650, 575 may be used to charge the battery 1131 and a capacitor may be used instead of or in addition to the battery as discussed above. Alternatively, the power sub 1100 may include a protector sleeve covering the fingers 1110*f* in the retracted position and retracting when the fingers extend so as not to obstruct extension of the fingers. Alternatively, slips and a cone, drag blocks, dogs, or radial pistons may be used instead of the fingers 1110*f*. Alternatively, the fingers 1110*f* may longitudinally connect the mandrel 1110 and the shifting tool 1175 and the power sub 1100 may be operated by longitudinal movement of the shifting tool.

Figure 13A:
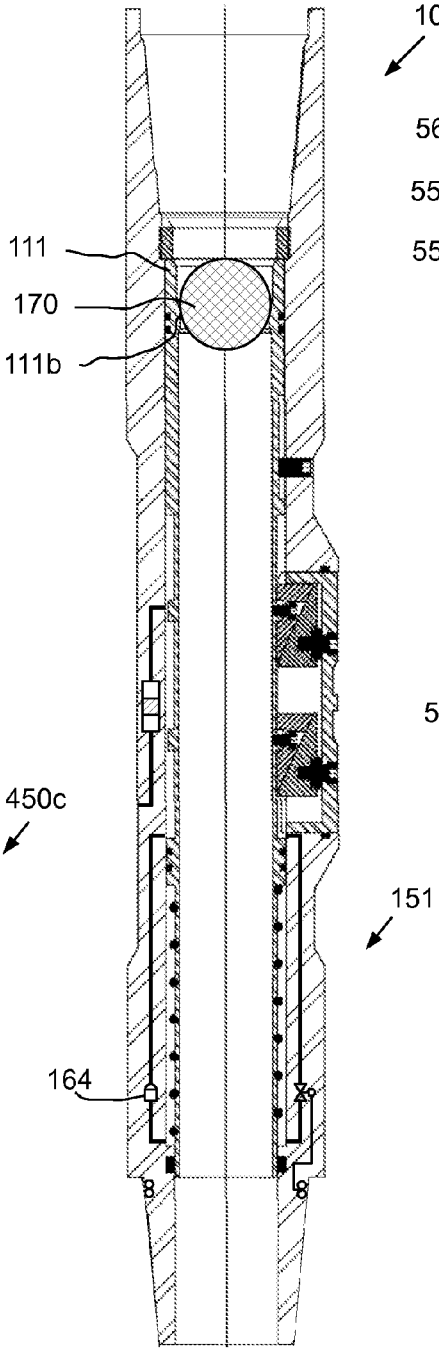
FIG. 13A is a cross-section of a shifting tool for actuating the isolation assembly between the positions, according to another embodiment of the present invention.

FIG. 13A is a cross-section of a shifting tool 101 for actuating the isolation assembly between the positions, according to another embodiment of the present invention. The shifting tool 101 may be similar to the shifting tool 100 except for including a manual override. The manual override may include a piston 111 (instead of the piston 110) and the hydraulic lock 151 (instead of the hydraulic lock 150). The piston 111 may be similar to the piston 110 except that a seat 111*b* may be formed in an inner surface thereof for receiving a blocking member, such as a ball 170. The lock 151 may be similar to the lock 150 except that a frangible member, such as a rupture disk 164, may replace the check valve 154. Alternatively, a pressure relief valve may be used instead of the rupture disk. In the event that the telemetry sub 200 and/or the hydraulic lock 151 is damaged during drilling, the ball 170 may be deployed, such as by pumping, through the drill string until the ball lands on the seat 111*b*. Pumping may continue, thereby exerting fluid force on the ball 170 and seat 111*b* until pressure in the lower chamber equals or exceeds a rupture pressure of the disk 164. Once ruptured, pressure in the lower chamber may be relieved by fluid flowing through the opened passage 159*c* to the lower chamber, thereby also unlocking the piston 111 to move downward and extending the drivers into engagement with any of the power subs, discussed above. The isolation valve may then be closed and the drill string retrieved to the rig.

Figure 13B:
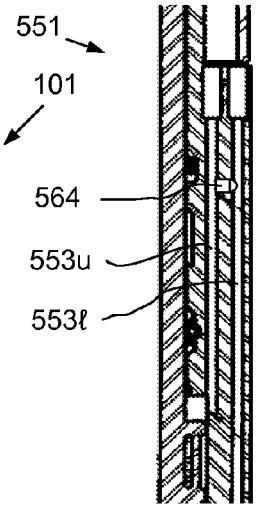
FIGS. 13B and 13C illustrate a portion of an isolation valve in the closed position, according to another embodiment of the present invention.
Figure 13C:
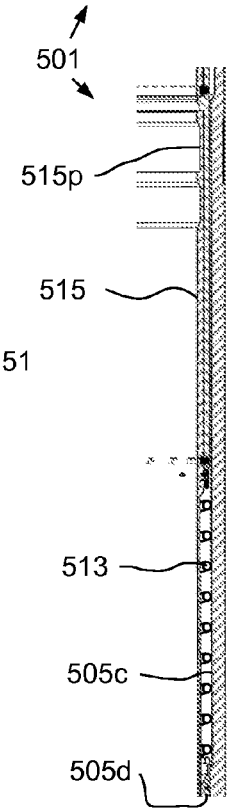

FIGS. 13B and 13C illustrate a portion of an isolation valve 501 in the closed position, according to another embodiment of the present invention. The isolation valve 501 may be similar to the isolation valve 500 except for including a manual override. The manual override may include an actuator 551 (instead of the actuator 550) and a biasing member, such as a coil spring 513. The spring 513 may be added between the flow tube 515 and the housing 505. The spring 513 may be disposed against a top of the housing section 505*d* and a shoulder of the flow tube 515, thereby biasing the flow tube away from the flapper 520. The actuator 551 pump may generate sufficient pressure to overcome the bias of the spring when opening the valve 501. A profile 515*p* may be formed in an inner surface of the flow tube 515. The actuator 551 may be similar to the actuator 550 except that a frangible member, such as a rupture disk 564, may be added. Alternatively, a pressure relief valve may be used instead of the rupture disk. The rupture disk 564 may be in fluid communication with the hydraulic passages 553*u,l*. A redundant shifting tool (not shown) may be assembled as part of the drill string.

In the event that the actuator 551 is damaged during drilling, the shifting tool may be extended into engagement with the profile 515*p*. The drill string may be pulled upward from the drilling rig, thereby pulling the flow tube 515. Pressure may increase in the passage 553*l* until the pressure equals or exceeds the rupture pressure of the disk 564. Once ruptured, pressure in the upper passage may be relieved by fluid flowing through the ruptured disk 564 to the lower passage, thereby also unlocking the flow tube 515 to move upward and allowing the flapper spring 521 to close the flapper 520. The drill string may then be retrieved to the rig.

While the foregoing is directed to embodiments of the present invention, other and further embodiments of the invention may be devised without departing from the basic scope thereof, and the scope thereof is determined by the claims that follow.

The invention claimed is:

1. A method of drilling a wellbore, comprising:

drilling the wellbore through a formation by injecting drilling fluid through a drill string and rotating a drill bit, wherein the drill string comprises a shifting tool, an antenna in communication with the shifting tool and located adjacent to a bore of the drill string, a microprocessor in communication with the antenna and the shifting tool, and the drill bit;

retrieving the drill string from the wellbore through a casing string until the shifting tool reaches an actuator, wherein the casing string comprises an isolation valve in an open position and the actuator;

pumping a wireless instruction tag (WIT) down the bore of the drill string to the antenna, thereby sending a wireless instruction signal to the antenna, wherein the microprocessor causes the shifting tool to engage the actuator in response to the antenna receiving the instruction signal; and operating the actuator using the engaged shifting tool, thereby closing the isolation valve and isolating the formation from an upper portion of the wellbore.

2. The method of claim 1, wherein the actuator is operated by longitudinally moving the drill string.

3. The method of claim 1, wherein the actuator is operated by rotating the drill string.

4. The method of claim 1, further comprising detecting a position of the actuator or isolation valve after operating the actuator.

5. The method of claim 4, wherein:
the actuator comprises a wireless identification tag (WIT) embedded therein, and
the position is detected using the WIT.

6. The method of claim 4, wherein:
the isolation valve comprises an wireless identification tag (WIT) dispenser,
the tag dispenser is operable to release a WIT encoded with the position of the valve in response to closure of the valve, and
the position is detected by reading the dispensed tag.

7. The method of claim 4, wherein:
the isolation valve comprises a flapper, and
the position of the flapper is detected.

8. The method of claim 7, further comprising:
communicating the detected position to the shifting tool; and
sending the detected position to surface wirelessly.

9. The method of claim 1, wherein the instruction signal is sent from a drilling rig.

10. The method of claim 1, wherein the instruction signal is sent from the casing string.

11. A method of drilling a wellbore, comprising:
drilling the wellbore through a formation by injecting drilling fluid through a drill string and rotating a drill bit;
retrieving the drill string from the wellbore through a casing string until the drill bit is above a closure member, wherein the casing string comprises the closure member in an open position and an actuator having an antenna;
pumping a closer wireless identification tag (WIT) through the drill string and up an annulus between the drill string and the casing string, wherein:
the closer WIT passes in range of the antenna, and
the actuator closes the closure member in response to communication with the closer WIT, thereby isolating the formation from an upper portion of the wellbore;
removing the drill string from the wellbore;
deploying a workstring or the drill string into the wellbore;
pumping an opener WIT through the drill string or workstring and up the annulus, wherein:
the opener WIT passes in range of the antenna, and
the actuator opens the closure member in response to communication with the opener WIT.

12. The method of claim 11, wherein:
the drill string comprises a charger, and
the method further comprises charging a battery or capacitor of the actuator.

13. The method of claim 12, wherein the battery or capacitor is charged wirelessly.

14. The method of claim 12, wherein:
the charger comprises an electromagnet, and
the battery or capacitor is charged by longitudinally moving the charger relative to the isolation valve.

15. The method of claim 11, wherein:
the isolation valve comprises a thermoelectric generator, and
the method further comprises charging a battery or capacitor of the actuator by circulating drilling fluid through the wellbore.

16. The method of claim 11, further comprising detecting a position of the actuator or closure member after the closure member is closed.

17. The method of claim 16, wherein the position of the closure member is detected.

18. The method of claim 16, wherein:
a wireless identification tag (WIT) dispenser is connected to the closure member,
the tag dispenser is operable to release a WIT encoded with the position of the valve in response to closing the closure member, and
the position is detected by reading the dispensed tag.

19. The method of claim 16, further comprising sending the detected position to surface wirelessly.

20. The method of claim 11, wherein:
the casing string comprises a hydraulic pump in fluid communication with a bore of the casing, an accumulator, and a piston operably coupled to the closure member,
the pump charges the accumulator in response to pressure fluctuations in the casing bore, and
the actuator selectively provides fluid communication between the accumulator and the piston.

21. A method of drilling a wellbore, comprising:
drilling the wellbore through a formation by injecting drilling fluid through a drill string and rotating a drill bit, the drill string comprising opener and closer wireless identification tags (WITs) embedded in a lower portion of the drill string, wherein the opener WIT is located above the closer WIT; and
retrieving the drill string from the wellbore through a casing string until the drill bit is above a closure member, wherein:
the casing string comprises the closure member in an open position and an actuator having a microprocessor, a position sensor, and an antenna for communication with the WITs,
the WITs are spaced apart by a sufficient distance so that the tags are not simultaneously in range of the antenna,
the microprocessor reads the opener WIT first and ignores the opener WIT based on the current open position of the closure member, and
the microprocessor then reads the closer WIT and closes the closure member, thereby isolating the formation from an upper portion of the wellbore.

* * * * *